US008027630B2

(12) United States Patent
Fujii et al.

(10) Patent No.: US 8,027,630 B2
(45) Date of Patent: Sep. 27, 2011

(54) SHEET PROCESSING APPARATUS, SHEET PROCESSING METHOD, AND IMAGE FORMING SYSTEM

(75) Inventors: Takayuki Fujii, Tokyo (JP); Tsuyoshi Moriyama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 642 days.

(21) Appl. No.: 11/772,554

(22) Filed: Jul. 2, 2007

(65) Prior Publication Data

US 2008/0122156 A1 May 29, 2008

(30) Foreign Application Priority Data

Jul. 3, 2006 (JP) ..... 2006-183478

(51) Int. Cl.
*G03G 15/00* (2006.01)

(52) U.S. Cl. ..... 399/407; 399/403

(58) Field of Classification Search ..... 399/407
See application file for complete search history.

(56) References Cited

U.S. PATENT DOCUMENTS 5,231,516 A * 7/1993 Kamon et al. ..... 358/449
6,029,026 A * 2/2000 Natsume et al. ..... 399/82
6,408,750 B1 * 6/2002 Goto et al. ..... 101/226
7,137,625 B2 11/2006 Yamada et al.
7,354,233 B2 * 4/2008 Oki et al. ..... 412/16
7,599,639 B2 * 10/2009 Watanabe et al. ..... 399/88
7,651,092 B2 * 1/2010 Hirao et al. ..... 271/298
7,744,325 B2 * 6/2010 Ushio et al. ..... 412/1
2001/0019191 A1 * 9/2001 Yoshie et al. ..... 270/52.17
2002/0060388 A1 * 5/2002 Wakabayashi et al. .... 270/58.08
2003/0020956 A1 * 1/2003 Goel et al. ..... 358/1.18
2004/0170462 A1 9/2004 Awano
2004/0247356 A1 * 12/2004 Kaneko et al. ..... 399/407
2005/0230895 A1 * 10/2005 Kawatsu et al. ..... 270/52.17
2006/0279035 A1 * 12/2006 Aoyagi et al. ..... 270/32
2007/0035079 A1 2/2007 Yamada et al.

(Continued)

FOREIGN PATENT DOCUMENTS

EP 1 531 060 A 5/2005

(Continued)

OTHER PUBLICATIONS

English translation of JP 2004-210509 (publication date Jul. 29, 2004).*

(Continued)

*Primary Examiner* — Anthony H. Nguyen
(74) *Attorney, Agent, or Firm* — Fitzpatrick, Cella, Harper & Scinto

(57) ABSTRACT

A sheet processing apparatus which enable users to easily set the cutting amount of sheets according to the intended purpose of use. A folding unit folds the sheets. A cutting unit cuts off ends of the folded sheets. A setting unit sets details of processing of the sheets to be executed at least by the center-folding unit and the cutting unit. The setting unit is capable of selecting a first cutting amount-setting mode in which a cutting amount is set using a cutting width of the at least one end, and a second cutting amount-setting mode in which the cutting amount is set using a sheet size which the sheets should have after being cut. The setting unit sets the cutting amount in a selected one of the first cutting amount-setting mode and the second cutting amount-setting mode, when setting details of processing of the sheets to be executed by the cutting unit.

5 Claims, 34 Drawing Sheets

U.S. PATENT DOCUMENTS

2007/0035080 A1 2/2007 Yamada et al.

FOREIGN PATENT DOCUMENTS

| | | | |
|---|---|---|---|
| JP | 2003-341919 | A | 12/2003 |
| JP | 2004-210509 | A | 7/2004 |
| JP | 2005-088110 | A | 4/2005 |

OTHER PUBLICATIONS

European Communication dated Oct. 7, 2008 in European Application No. 07111555.4-1256/1876125.

Japanese Office Action dated Mar. 29, 2011, in counterpart Japanese Patent Application No. 2006-183478.

* cited by examiner

EDGE CUTTING

TOP-AND-BOTTOM CUTTING

NON-SORTING OPERATION

SORTING OPERATION

SORTING OPERATION

SECOND BUNDLE-SORTING OPERATION

SECOND BUNDLE-SORTING OPERATION

SECOND BUNDLE-SORTING OPERATION

SECOND BUNDLE-SORTING OPERATION

BOOKBINDING MODE OPERATION

BOOKBINDING MODE OPERATION

BOOKBINDING MODE OPERATION

BOOKBINDING MODE OPERATION

BOOKBINDING MODE OPERATION FOR SECOND BUNDLE

BOOKBINDING MODE OPERATION FOR SECOND BUNDLE

CUTTING OPERATION

CUTTING OPERATION

CUTTING OPERATION

CUTTING OPERATION

SADDLE-STITCHED BUNDLE

PRIOR ART

SHEET PROCESSING APPARATUS, SHEET PROCESSING METHOD, AND IMAGE FORMING SYSTEM

BACKGROUND OF THE INVENTION

1. Field of the Invention

The present invention relates to a sheet processing apparatus having a cutting function, a sheet processing method, and an image forming system.

2. Description of the Related Art

Conventionally, an image forming system is known which has a post-processing apparatus (sheet processing apparatus) connected to an image forming apparatus, such as a copying machine and a laser printer, thereby having the capability of operating in a bookbinding mode for performing a bookbinding process. In this bookbinding mode, there are carried out a saddle stitching process for stitching sheets at a center thereof, and a folding process for folding sheets at a center thereof.

FIG. 46 is a view of a bundle of sheets subjected to a conventional saddle stitching and center-folding process. In a book-bound sheet bundle, when the number of sheets in the bundle is large or the thickness of each sheet in the bundle is large, the respective positions of opposite ends of folded sheets of the bundle are not aligned between the inner sheets and outer sheets, which degrades the appearance of the finished sheet bundle. As a solution to this, a post-processing apparatus has been proposed which is equipped with a cutting function for cutting off the ragged end of a sheet bundle by a width of several mm using, e.g., a cutter, to thereby align the respective ends of sheets for improvement of the appearance of the finished bundle (see Japanese Laid-Open Patent Publication (Kokai) No. 2003-341919).

Further, when cutting is performed, the ragged portions L are cut off (see FIG. 46). Therefore, from the viewpoint of operability, it is a method easy for users to understand to designate a length to be cut off from the ragged side end of a sheet bundle, and hence such a method of setting a cutting amount is conventionally employed (Japanese Patent Publication (Kokai) No. 2004-210509).

However, in the conventional sheet processing apparatus, there remains room to be improved in the following points:

Recently, elongated sizes which are slightly longer than respective predetermined standard sizes come to be used in printers, e.g., of copying machines. When sheets having such an elongated size are used, a margin is secured along the sides of each sheet, and an image having a predetermined size is formed in a central area of the sheet. The sheet having the image formed thereon is subjected to a cutting process for cutting off the margins along the sides of the sheet.

Thus, the user performs the cutting process on a bundle of book-bound sheets having an elongated size, not only for cutting off the ragged portions but also for cutting off the margins along the sides of the sheets.

Therefore, for a user who wants to cut off unwanted portions, such as margins, of sheets, according to the size of images formed on the sheets, there arises the following problems: When designating a cutting length (cutting width) from sheet end, the user is required to grasp the size of recording sheets, and the size of images to be printed thereon in advance, and then set a cutting amount by calculation. This makes an error in setting the cutting amount liable to occur, which degrades the user friendliness.

SUMMARY OF THE INVENTION

The invention provides a sheet processing apparatus, a sheet processing method, and an image forming system, which enable users to easily set a cutting amount according to the intended purpose of use.

In a first aspect of the present invention, there is provided a sheet processing apparatus that processes sheets, comprising a center-folding unit adapted to fold the sheets at a center thereof, a cutting unit adapted to cut off at least one end of the folded sheets, and a setting unit adapted to set details of processing of the sheets to be executed at least by the center-folding unit and the cutting unit, the cutting unit being capable of selecting a first cutting amount-setting mode in which a cutting amount is set using a cutting width of the at least one end, and a second cutting amount-setting mode in which the cutting amount is set using a sheet size which the sheets should have after being cut, and being operable to set the cutting amount in a selected one of the first cutting amount-setting mode and the second cutting amount-setting mode, when setting details of processing of the sheets to be executed by the cutting unit.

With the arrangement of the sheet processing apparatus according to the first aspect of the present invention, the cutting amount is set in the first cutting amount-setting mode using the cutting width of the at least one end of the folded sheets or in the second cutting amount-setting mode using the sheet size which the sheets should have after being cut. Therefore, the user is capable of easily setting the cutting amount depending on the intended purpose of use. Therefore, even when margins extending along the sides of each sheet are to be cut off, it is possible to prevent the user from erroneously setting the cutting amount to thereby improve operability.

The setting unit can be capable of selecting between one end-cutting mode in which only one end of the folded sheets opposite to an folded end thereof formed by folding the sheets is cut off, and a multiple end-cutting mode in which a plurality of ends of the folded sheets except the folded end are cut off, and when the one end-cutting mode is selected, the setting unit can set the cutting amount in the first cutting amount-setting mode, whereas when the multiple end-cutting mode is selected, the setting unit can set the cutting amount in one of the first cutting amount-setting mode and the second cutting amount-setting mode.

With the arrangement of this embodiment of the sheet processing apparatus, it is possible to set the cutting amount in one of the cutting amount-setting modes which is suited to the selected cutting mode. This improves the user friendliness of the processing apparatus.

The setting unit can set the cutting amount in the selected one of the first cutting amount-setting mode and the second cutting amount-setting mode, depending on the size of the sheets to be processed.

With the arrangement of the sheet processing apparatus according to this embodiment, it is possible to improve the user operability of the apparatus.

When the size of the sheets to be processed is a standard size, the setting unit can set the cutting amount in the first cutting amount-setting mode, whereas when the size of the sheets to be processed is an elongated size, the setting unit can set the cutting amount in the second cutting amount-setting mode.

With the arrangement of the sheet processing apparatus according to this embodiment, it is possible to make the apparatus compatible with sheets with elongated sizes.

The sheet processing apparatus can further comprise a saddle-stitching unit adapted to perform saddle stitching on a plurality of sheets laid over each other, and the setting unit can set whether to carry out both the saddle stitching and the folding of the sheets at the center thereof or to carry out only the folding of the sheets at the center thereof without performing the saddle stitching.

In a second aspect of the present invention, there is provided a method of processing sheets, comprising a setting step of setting details of processing of the sheets, a center-folding step of folding the sheets at a center thereof, according to the set details of the processing, and a cutting step of cutting off at least one end of the folded sheets according to the set details of the processing, wherein the setting step is capable of selecting a first cutting amount-setting mode in which a cutting amount is set using a cutting width of the at least one end, and a second cutting amount-setting mode in which the cutting amount is set using a sheet size which the sheets should have after being cut, and includes setting the cutting amount in a selected one of the first cutting amount-setting mode and the second cutting amount-setting mode, when setting details of processing of the sheets to be executed by the cutting unit.

With the arrangement of the method according to the second aspect of the present invention, it is possible to obtain the same advantageous effects as provided by the sheet processing apparatus according to the first aspect of the present invention.

In a third aspect of the present invention, there is provided an image forming system that includes an image forming apparatus, and a sheet processing apparatus, in which sheets on which images are formed by the image forming apparatus are processed by the sheet processing apparatus, comprising a receiver unit adapted to receive sheets discharged from the image forming apparatus, a center-folding unit adapted to fold the sheets at a center thereof, a cutting unit adapted to cut off at least one end of the folded sheets, and a setting unit adapted to set details of processing of the sheets to be executed at least by the center-folding unit and the cutting unit, the setting unit being capable of selecting a first cutting amount-setting mode in which a cutting amount is set using a cutting width of the at least one end, and a second cutting amount-setting mode in which the cutting amount is set using a sheet size which the sheets should have after being cut, and being operable to set the cutting amount in a selected one of the first cutting amount-setting mode and the second cutting amount-setting mode, when setting details of processing of the sheets to be executed by the cutting unit.

With the arrangement of the image forming system according to the third aspect of the present invention, it is possible to obtain the same advantageous effects as provided by the sheet processing apparatus according to the first aspect of the present invention.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing preferred embodiment thereof.

Figure 1:
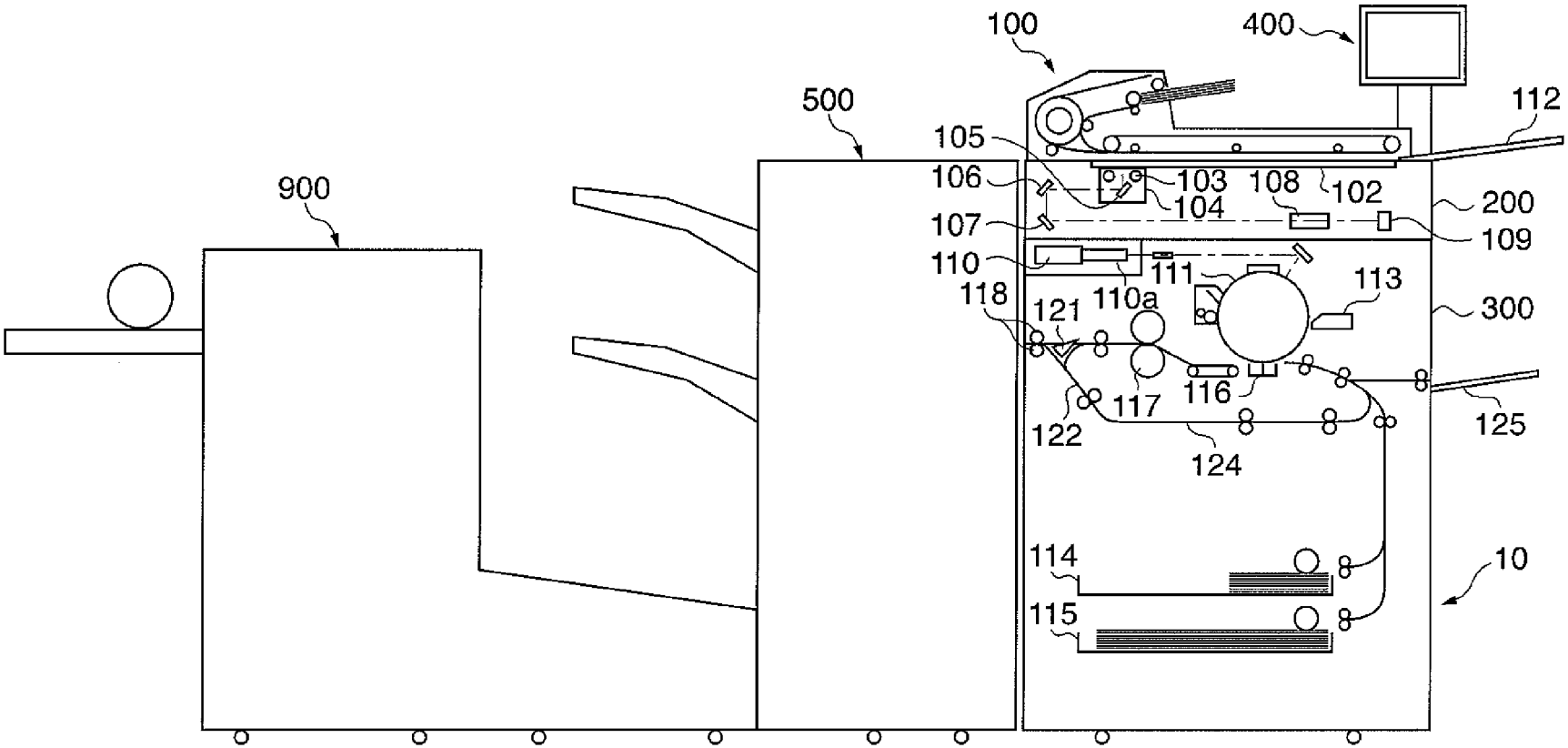
FIG. 1 a schematic diagram of an image forming system according to a first embodiment of the present invention.

FIG. 1 is a view of an image forming system according to a first embodiment of the present invention. The image forming system is comprised of an image forming apparatus 10, a finisher 500, and a trimmer 900. The image forming apparatus 10 includes an image reader 200 that reads original images, and a printer 30.

The image reader 200 is equipped with an original feeder 100. The original feeder 100 sequentially feeds originals set on an original tray with their front surfaces facing upward, one by one, from the leading page in a leftward direction as viewed in FIG. 1, such that the originals are guided along a curved path and conveyed from the left onto a platen glass 102 and then through a moving original reading position to the right, followed by being discharged to an external discharge tray 112.

As each original passes the moving original reading position on the platen glass 102 from left to right, an image of the original is read by a scanner unit 104 held in a position corresponding to the moving original reading position. This reading method is generally called the "moving original reading method". More specifically, as the original passes the moving original reading position, a surface of the original to be scanned is irradiated with light from a lamp 103 of the scanner unit 104, and reflected light from the original is guided into a lens 108 via mirrors 105, 106, and 107. The light having passed through the lens 108 forms an image on an imaging surface of an image sensor 109.

Each original is thus conveyed so as to pass the moving original reading position from left to right, whereby scanning is performed to read the original with a direction orthogonal to the conveying direction of the original as the main scanning direction and the conveying direction of the original as the sub scanning direction. More specifically, as the original passes the moving original reading position, the image of the original is read line by line in the main scanning direction by the image sensor 109 while the original is being fed in the sub scanning direction, whereby the whole original image is read. The original image optically read by the image sensor 109 is converted into image data by the same for output to an image signal control section 202, referred to hereinafter. The image data output from the image sensor 109 is subjected to predetermined processing by the image signal control section 202, and then discharged as a video signal to an exposure control section 110 of the printer 300.

Alternatively, it is also possible to convey the original to a predetermined position on the platen glass 102 and temporarily stop the same, and cause the scanner unit 104 to scan the original from left to right to thereby read the original. This reading method is the so-called "stationary original reading method". In the case of reading an original without using the original feeder 100, first, the user lifts the original feeder 100 and places an original on the platen glass 102, whereafter the scanner unit 104 is caused to scan the original from left to right to read the same. In short, when the original feeder 100 is not used for reading an original, stationary original reading is performed.

The exposure control section 110 of the printer 300 modulates a laser beam based on the video signal output from the image reader 200 and then outputs the modulated laser beam. The laser beam is irradiated onto a photosensitive drum 111 while being scanned by a polygon mirror 110*a*. On the photosensitive drum 111, an electrostatic latent image is formed according to the scanned laser beam. When stationary original reading is performed, the exposure control section 110 outputs the laser beam such that a proper image (non-mirror image) is formed.

The electrostatic latent image formed on the photosensitive drum 111 is visualized as a developer image by a developer supplied from a developing device 113. On the other hand, a sheet is fed from a cassette (sheet cassette) 114 or 115, a manual sheet feeder 125, or a double-sided conveying path 124, and is conveyed in between the photosensitive drum 111 and a transfer section 116 in timing synchronized with the start of irradiation of the laser beam. The developer image formed on the photosensitive drum 111 is transferred onto the fed sheet by the transfer section 116. The sheet having the developer image transferred thereon is conveyed to a fixing section 117, and the fixing section 117 fixes the developer image on the sheet by heating and pressing the sheet. The sheet having passed through the fixing section 117 passes through a flapper 121 and discharge rollers 118 so as to be discharged from the printer 300 to the outside of the image forming apparatus 10 (into the finisher 500).

When the sheet is to be discharged face-down, i.e. with an image-formed surface thereof facing downward, the sheet having passed through the fixing section 117 is temporarily guided into an inverting path 122 by switching operation of the flapper 121, and then, after the trailing edge of the sheet has passed through the flapper 121, the sheet is switched back and discharged from the printer 300 by the discharge rollers 118. This sheet discharge mode will be hereinafter referred to as "inverted discharge". The inverted discharge is carried out when images are sequentially formed starting with the leading page, e.g. when images read using the original feeder 100 are formed or when images output from a computer are formed. The sheets thus discharged by the inverted discharge are stacked in the correct page order.

When a hard sheet, such as an OHP sheet, is supplied from the manual sheet feeder 125, and an image is formed on this sheet, the sheet is not guided into the inverting path 122, and hence discharged by the discharge rollers 118, face-up, i.e. with an image-formed surface thereof facing upward.

Further, when a double-sided printing mode for forming images on both sides of a sheet is set, the sheet is guided into the inverting path 122 by switching operation of the flapper 121, and then conveyed to a double-sided conveying path 124, followed by being fed in again between the photosensitive drum 111 and the transfer section 116 in the timing in synchronism with the start of irradiation of the laser beam.

On the other hand, the sheet discharged from the printer 300 is sent to the finisher 500. The finisher 500 performs post-processing on the sheet discharged from the printer 300. Further, the trimmer 900 performs a process for cutting ends of sheets saddle-stitched and folded at the center by the finisher 500.

Figure 2:
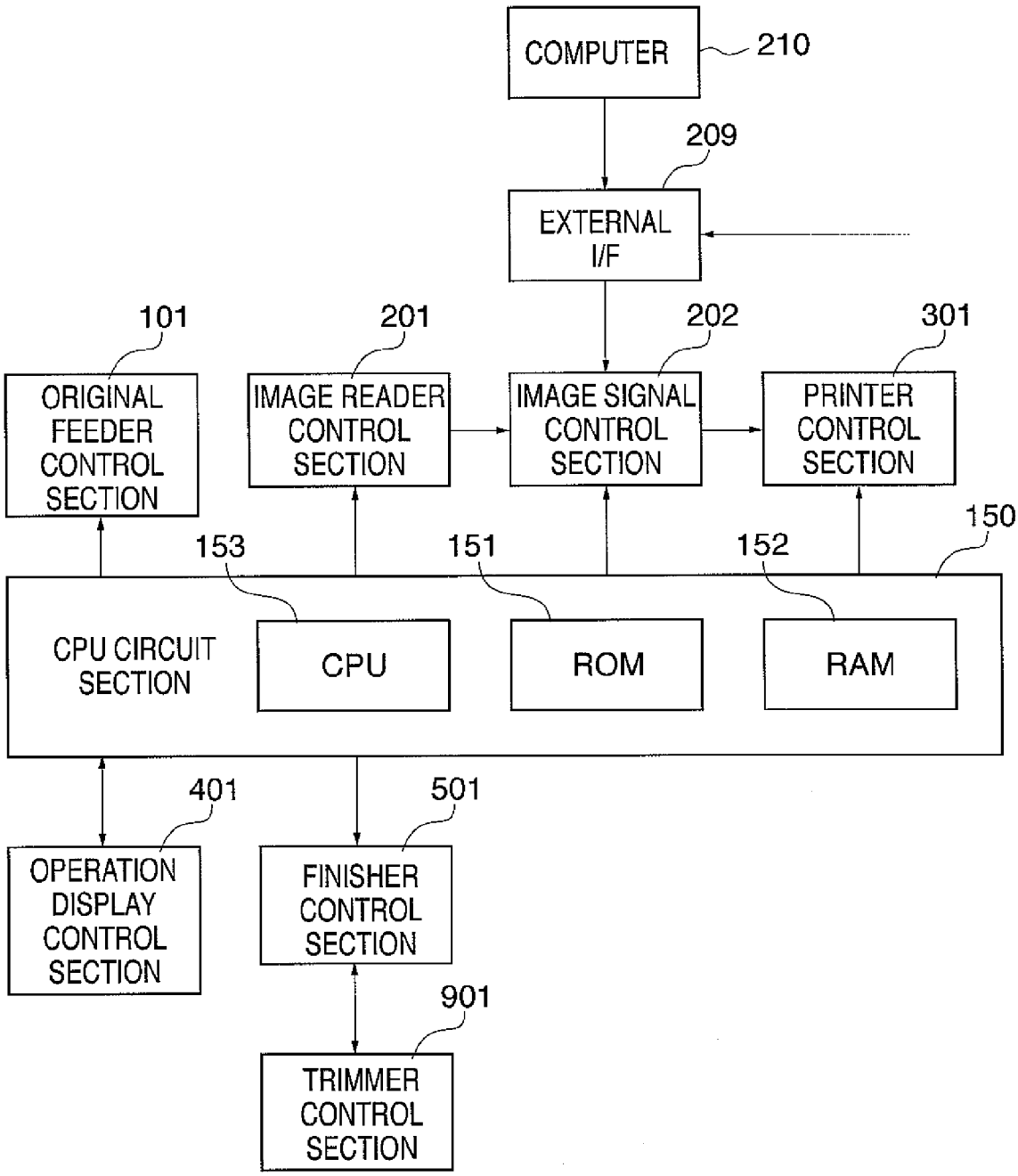
FIG. 2 is a block diagram of a controller that controls the overall operation of the image forming system.

FIG. 2 is a block diagram showing the arrangement of a controller that controls the overall operation of the image forming system. The controller is mainly formed of a CPU circuit section 150, and the CPU circuit section 150 is connected to an original feeder control section 101, an image reader control section 201, the image signal control section 202, a printer control section 301, an operation display control section 401, and a finisher control section 501. The image signal control section 202 is connected to an external interface (I/F) 209 connected to the computer 210. Further, the finisher control section 501 is connected to the trimmer control section 901.

The CPU circuit section 150 incorporates a CPU 153, a ROM 151, and a RAM 152, and performs centralized control of the above-mentioned sections 101, 201, 202, 209, 301, 401, 501, by the CPU 153 executing control programs stored in the ROM 151. The RAM 152 temporarily stores control data, and is also used as a work area for carrying out arithmetic operations when the CPU 153 executes the control programs.

The original feeder control section 101 drivingly controls the original feeder 100 according to instructions from the CPU circuit section 150. The image reader control section 201 drivingly controls the scanner unit 104, the image sensor 109, and so forth, and transfers an analog image signal output from the image sensor 109 to the image signal control section 202.

The image signal control section 202 converts the analog image signal from the image sensor 109 into a digital signal, then performs various kinds of processing on the digital signal, and converts the processed digital signal into a video signal, followed by delivering the video signal to the printer control section 301. Further, the image signal control section 202 performs various kinds of processing on a digital image signal input from the computer 210 via the external I/F 209, and converts the processed digital image signal into a video signal, followed by delivering the video signal to the printer control section 301. The processing operations executed by the image signal control section 202 are controlled by the CPU circuit section 150.

The printer control section 301 drives the exposure control section 110 based on the received video signal. The finisher control section 501 is incorporated in the finisher 500, and exchanges information with the CPU circuit section 150 to thereby control the overall operation of the finisher 500.

The trimmer control section 901 is installed on the trimmer 900, and exchanges information with the finisher control section 501, to drivingly control the whole trimmer.

The operation display control section 401 controls exchange of information with the operating/display unit 400 and the CPU circuit section 150. The operating/display unit 400 includes a plurality of keys for configuring various functions for image formation, and a display section for displaying information indicative of the configurations. The operation display control section 401 outputs key signals corresponding to respective operations of keys to the CPU circuit section 150, and displays the corresponding pieces of information on the display section based on signals from the CPU circuit section 150.

Figure 3:
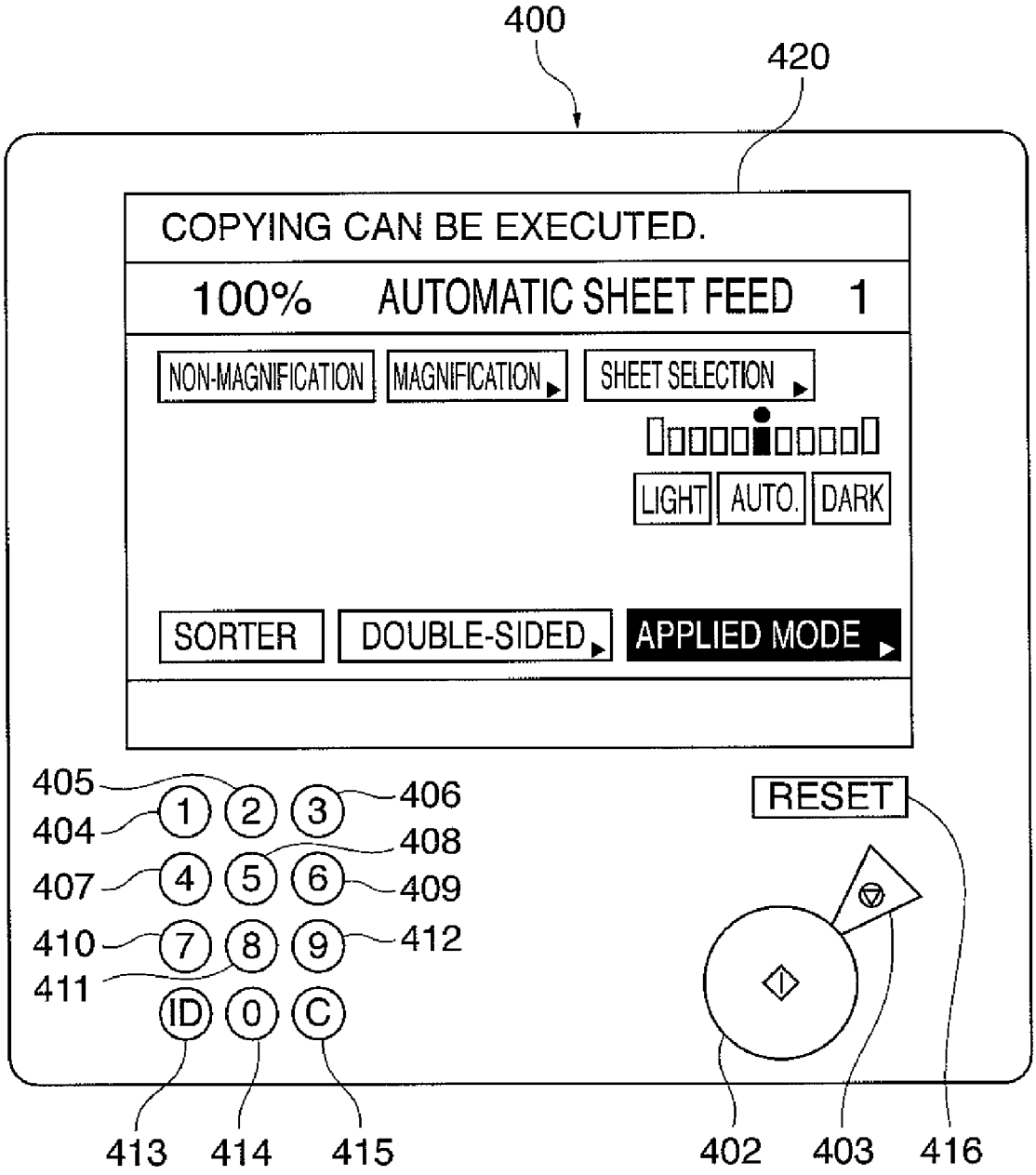
FIG. 3 is a view showing the appearance of an operating/display unit.

FIG. 3 is a view showing the appearance of the operating/display unit 400. On the operating/display unit 400, there are arranged a start key 402 for starting image forming operation, a stop key 403 for interrupting the image forming operation, a ten-key numeric keypad including keys 404 to 412 and 414 for setting input numbers, an ID key 413, a clear key 415, a reset key 416, and so forth. Further, the operating/display unit 400 includes a liquid crystal display 420 having a touch panel provided on the top thereof, where soft keys are provided.

The image forming system according to the present embodiment has a non-sorting mode, a sorting mode, a stapling sorting mode (binding mode), a bookbinding mode, and so forth, as the post-processing modes. These modes are set or configured by input operations from the operating/display unit 400. For example, when setting a post-processing mode, a soft key "sorter" is selected on the initial screen (see FIG. 3). In response to the selection, a sorter type-selecting screen is displayed on the liquid crystal display 420, and the post-processing mode is set using this sorter type-selecting screen.

Figure 4:
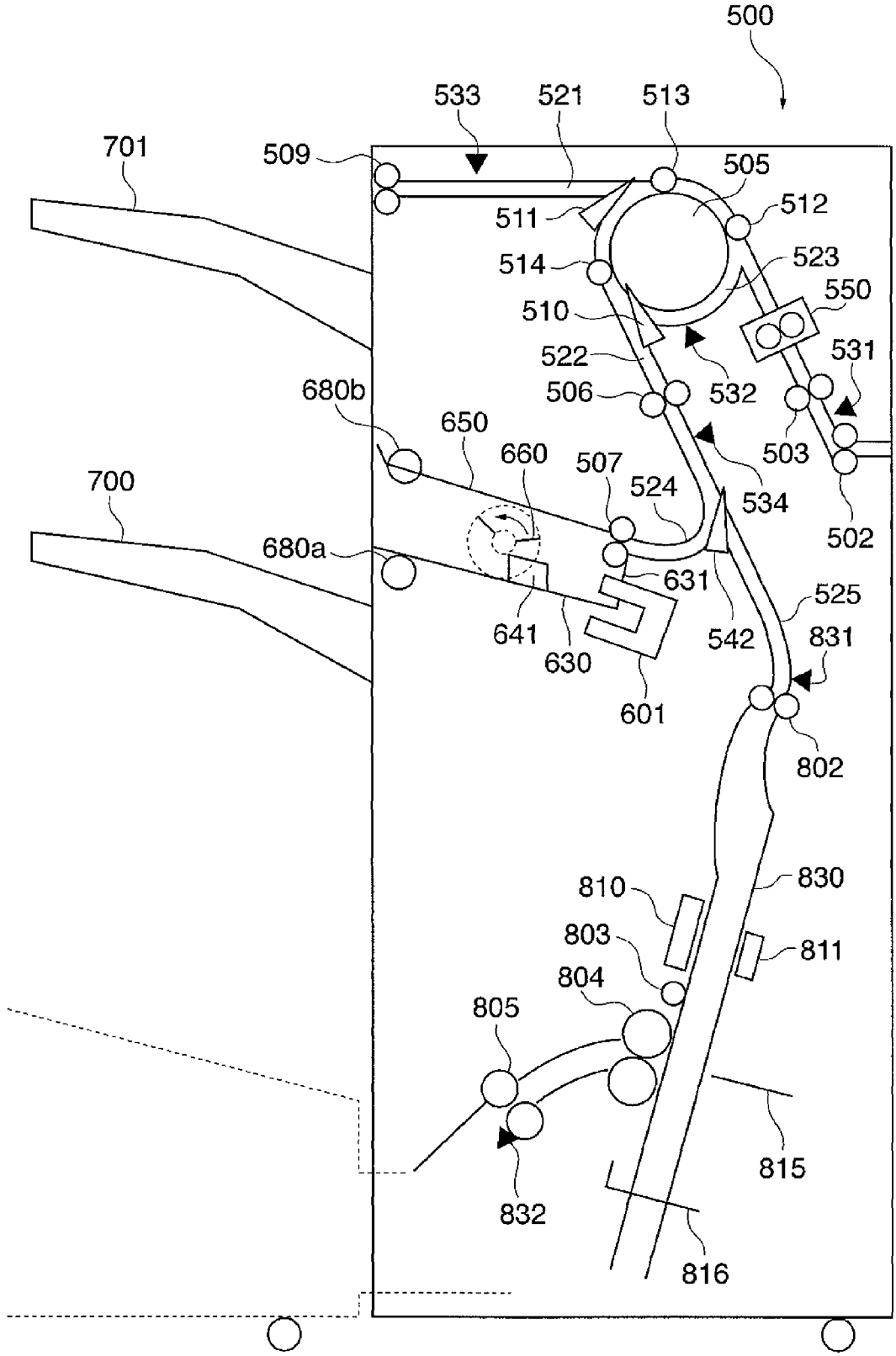
FIG. 4 is a longitudinal cross-sectional view of a finisher.

FIG. 4 is a longitudinal cross-sectional view showing the construction of the finisher 500. The finisher 500 performs various types of post-processing including processing for sequentially taking in sheets discharged from the image forming apparatus 10 and aligning the sheets taken in into a bundle, stapling processing for stapling the trailing end of the sheet bundle by a stapler, a punching process for punching holes in the trailing end of the sheet bundle, a sorting process, a non-sorting process, and a bookbinding process.

The finisher 500 takes in a sheet discharged from the image forming apparatus 10 by an inlet roller pair 502, and conveys the sheet taken in to a buffer roller 505 via a conveying roller pair 503. An inlet sensor 531 is disposed in a conveying path between the inlet roller pair 502 and the conveying roller pair 503. In a conveying path between the conveying roller pair 503 and the buffer roller 505, there is disposed a punching unit 550 which is operated, as required, to punch holes in a sheet conveyed thereto in the vicinity of the trailing edge thereof.

The buffer roller 505 is capable of winding a predetermined number of sheets conveyed thereto around the outer periphery thereof, and has pressing rollers 512, 513, and 514 provided around the outer periphery thereof, for winding sheets therearound during rotation thereof. The sheets wound around the outer periphery of the buffer roller 505 are conveyed in the direction of rotation (counterclockwise rotation, as viewed in FIG. 4) of the buffer roller 505.

A switching flapper 511 is disposed between the pressing rollers 513 and 514, while a switching flapper 510 is disposed at a location downstream of the pressing roller 514. The switching flapper 511 peels off the sheets wound around the buffer roller 505 to guide the same into a non-sorting path 521, or simply guides the same toward a sorting path 522, in the state wound around the buffer roller 505. On the other hand, the switching flapper 510 peels off the sheets wound around the buffer roller 505 to guide the same into the sorting path 522, or simply guides the same into a buffer path 523, in the state wound around the buffer roller 505.

When the sheets wound around the buffer roller 505 are to be guided into the non-sorting path 521, the switching flapper 511 is operated to peel off the sheets wound around the buffer roller 505 to guide the same into the non-sorting path 521. The sheets guided into the non-sorting path 521 are discharged onto a sample tray 701 via a discharge roller pair 509. In an intermediate portion of the non-sorting path 521, there is disposed a sheet discharge sensor 533.

When the sheets wound around the buffer roller 505 are to be guided into the buffer path 523, neither the switching flapper 510 nor the switching flapper 511 is operated, and the sheets are sent into the buffer path 523 in the state wound around the buffer roller 505. In an intermediate portion of the buffer path 523, there is disposed a buffer path sensor 532 that detects a sheet on the buffer path 523.

Further, when the sheets wound around the buffer roller 505 are to be guided into the sorting path 522, not the switching flapper 511 but the switching flapper 510 is operated to peel off the sheets wound around the buffer roller 505 to guide the sheets into the sorting path 522.

At a downstream location of the sorting path 522, a switching flapper 542 is disposed for guiding sheets into a sorting discharge path 524 or a bookbinding path 525. The sheets guided into the sorting discharge path 524 are stacked onto an intermediate tray (hereinafter referred to as the processing tray) 630 via a conveying roller pair 507.

The sheets stacked on the processing tray 630 as a bundle are subjected to the aligning processing by alignment members provided at front and rear sides thereof, the stapling processing, and so forth, as required, followed by being discharged onto a stack tray 700 by discharge rollers 680*a* and 680*b*.

The discharge roller 680*b* is supported by a swinging guide 650. The swinging guide 650 is swung by a swinging motor, not shown, to bring the discharge roller 680*b* into contact with a top sheet of a sheet bundle on the processing tray 630. When the discharge roller 680*b* is in contact with the top sheet on the processing tray 630, it is capable of cooperating with the discharge roller 680*a* to discharge the sheet bundle on the processing tray 630 toward the stack tray 700

The stapling processing is performed by a stapler 601. The stapler 601 is configured to be movable along the rear end of the processing tray 630 such that the stapler 601 can staple the trailing end (right-side end, as viewed in FIG. 4) of a sheet bundle stacked on the processing tray 630 with respect to the sheet conveying direction (leftward direction as viewed in FIG. 4).

Further, the sheet guided into the bookbinding path 525 is conveyed to a bookbinding intermediate tray (hereinafter referred to as "the bookbinding tray") 830 via a conveying roller pair 802. In an intermediate portion of the bookbinding path 525, a bookbinding inlet sensor 831 is provided. The bookbinding tray 830 is provided with an intermediate roller 803, and a movable sheet positioning member 816. Further, an anvil 811 is provided at a location opposed to a pair of staplers 810, and the stapler 810 and the anvil 811 cooperate to perform the stapling processing on the bundle of sheets received in the bookbinding tray 830.

A fold roller pair 804 is disposed at a location downstream of the staplers 810, and a thrusting member 815 is disposed at a location opposed to the fold roller pair 804. The thrusting member 815 is caused to project toward the sheet bundle received in the bookbinding tray 830, whereby the sheet bundle is pushed in between the fold roller pair 804. This causes the sheets to be folded at the center thereof. In the present embodiment, a maximum of three sheets can be folded. The fold roller pair 804 not only folds the sheet bundle but also conveys the folded sheet bundle downstream. Then, the conveying roller pair 805 passes the folded sheet bundle to the discharge tray 900. A discharge sensor 832 is disposed at a location downstream of the conveying roller pair 804.

Figure 5:
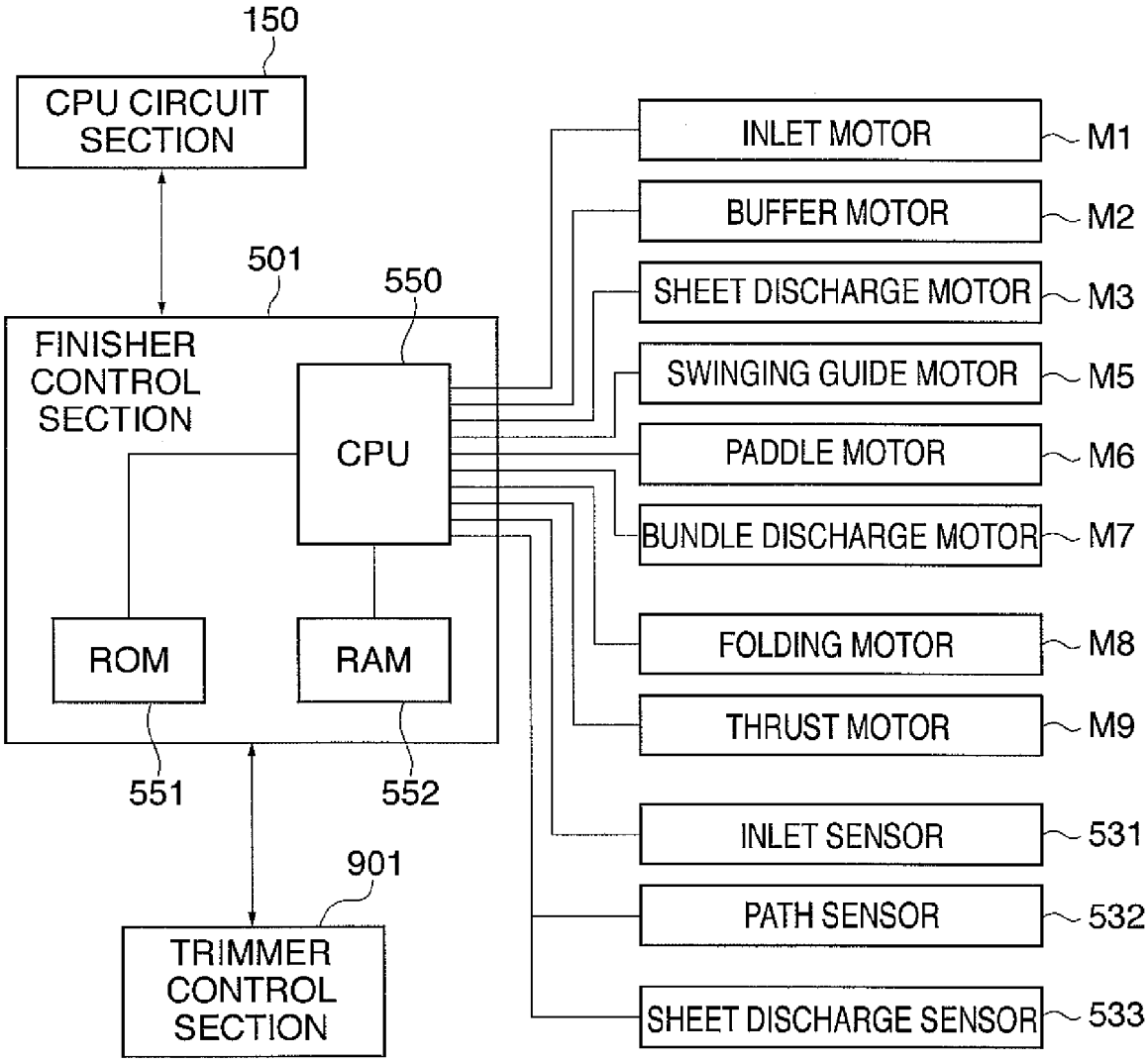
FIG. 5 is a block diagram of a finisher control section and components connected thereto.

FIG. 5 is a block diagram of the finisher control section 501 and components connected thereto. The finisher control section 501 is comprised of a CPU 550, a ROM 551, and a RAM 552. Connected to the CPU 550 are various motors M1 to M9, the inlet sensor 531, path sensors including the buffer path sensor 532 and the sheet discharge sensor 533, and so forth.

The finisher control section 501 communicates with the CPU circuit section 150 provided in the image forming apparatus 10 via a communication IC, not shown, for data exchange, and executes various programs stored in the ROM 552 to drivingly control the driving of the finisher 500 according to instructions from the CPU circuit section 150. Further, the finisher control section 501 performs communication with the trimmer control section 901, besides the image forming apparatus, via a communication IC (not shown).

Figure 6:
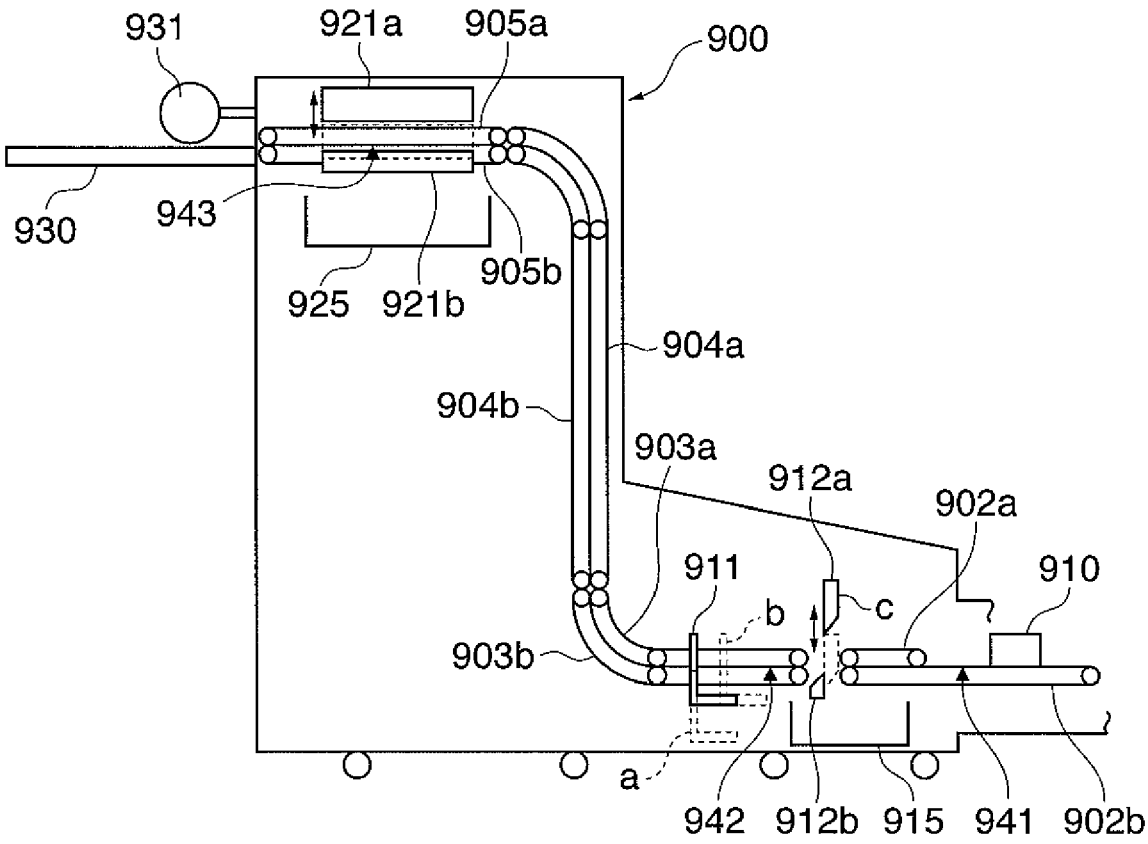
FIG. 6 is a longitudinal cross-sectional view of a trimmer.
Figure 7:
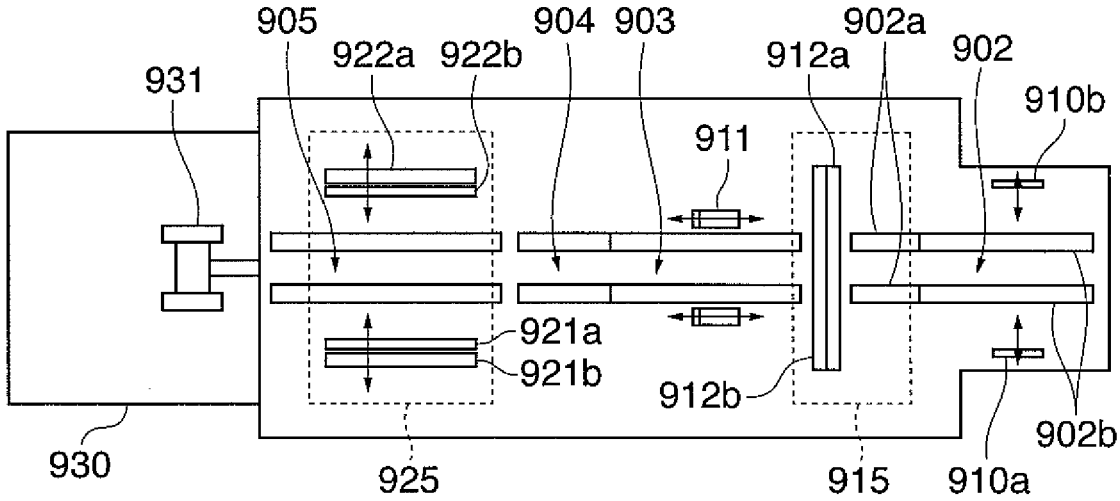
FIG. 7 is a top view of the trimmer.

FIG. 6 is a longitudinal cross-sectional view of the trimmer 900. FIG. 7 is a top view of the trimmer 900. The trimmer 900 receives the sheets folded at the center by the bookbinding section (bookbinding tray 830 and associated components) of the finisher 500, with reference to the center thereof. At this time, the sheets dropped from the conveying roller pair 805 of the finisher are sandwiched by a front-side aligning member 910*a* and a rear-side aligning member 910*b* provided at a receiving section of the trimmer 900, moved toward the center of the conveying path, and then conveyed by a conveyor belt 902 downstream, whereby the displacement of sheets occurring when they are passed from the finisher 500 are corrected.

In the conveying path within the trimmer 900, there are provided respective pairs 902, 903, 904, and 905 of upper and lower conveyor belts each at the same distance from the center of the conveying path, whereby sheets are conveyed while being sandwiched between the upper and lower conveyor belts.

Figure 8:
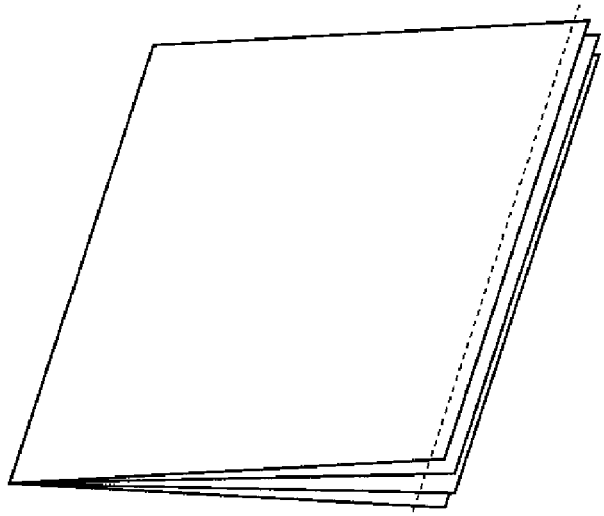
FIG. 8 is a view useful in explaining edge cutting.

Disposed between the conveyor belts 902 and 903 is a mechanism (edge cutting section) that performs cutting of an end of the sheet bundle opposite to the folded end formed by folding the sheet bundle (hereinafter referred to as "edge cutting") at the center. FIG. 8 is a view useful in explaining edge cutting. The sheets (bundle) conveyed to the cutting mechanism are caused to abut against the edge-cutting stopper 911 and stopped at a cutting position (see FIGS. 6 and 7). A vertically movable upper edge-cutting blade 912*a* is disposed at a location opposed to a fixed lower edge-cutting blade 912 where the stopped sheet bundle is stopped in a manner interposed therebetween, and the upper edge-cutting blade 912 is lowered to perform edge cutting of the sheet bundle (see a position indicated by a broken line in FIG. 8).

An edge-cutting stopper 911 vertically retractably protrudes with respect to the conveyor belts 903 (symbol "a" in FIG. 6 indicates the retracted position) so as to convey sheets downstream without performing edge cutting thereon or after performing edge cutting thereon. Further, the edge-cutting stopper 911 is horizontally movable in the conveying direction for switching the sheet stop position to a position dependent on the sheet size, or for adjusting the cutting position on a sheet bundle (symbol "b" in FIG. 6 designates a shifted position).

The cut-off chips from the sheet bundle are received in an edge-cut chip box 915. The upper edge-cutting blade 912*a* is on standby normally in a lifted position so as not to interfere with the conveyance of the sheets (symbol "c" in FIG. 6 designates the standby position).

Figure 9:
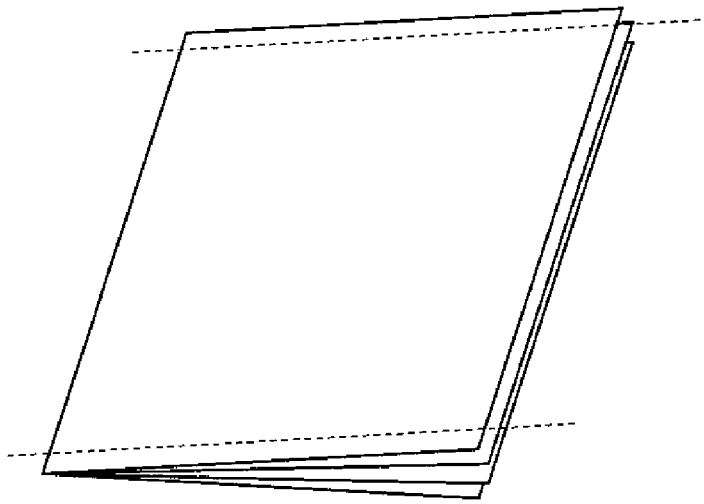
FIG. 9 is a view useful in explaining top-and-bottom cutting.

Further, a mechanism (top-and-bottom cutting section) for performing cutting ends orthogonal to the folded end (hereinafter referred to as "top-and-bottom cutting") is provided for the conveyor belts 905 disposed downstream of the edge cutting section. FIG. 9 is a view useful in explaining top-and-bottom cutting. Vertically fixed lower top-and-bottom-cutting blades 912*b* and 922*b* are provided at respective front and rear sides of the conveyor belts 905. Movable upper top-and-bottom-cutting blades 921*a* and 922*a* are lowered to the fixed lower top-and-bottom-cutting blades, whereby the sheets stopped in a state sandwiched between the conveyor belts 905 are subjected to top-and-bottom cutting similarly to edge cutting (see the position of a broken line in FIG. 9).

The top-and-bottom-cutting blades 921*a*, 921*b*, 922*a*, and 922*b* are movable transversely to the conveying direction, and are moved depending on the sheet size and for adjustment of the cutting positions. Chips cut off from the sheet bundle by the top-and-bottom cutting section are received in a top-and-bottom-cut chip box 925. When top-and-bottom cutting is not performed, the sheet bundle is conveyed downstream by the conveyor belts 905 without being stopped.

After passing through between the conveyor belts 905, the sheet bundle is discharged onto a stack tray 930. At this time, a large conveying roller 931 disposed above the stack tray 930 is driven to move the discharged sheet bundle on the stack tray 930. Further, sheet bundles already stacked on the stack tray 930 are also moved downstream thereon, thereby preventing sheet bundles from becoming resident at an outlet port of the conveyor belt 905.

Figure 10:
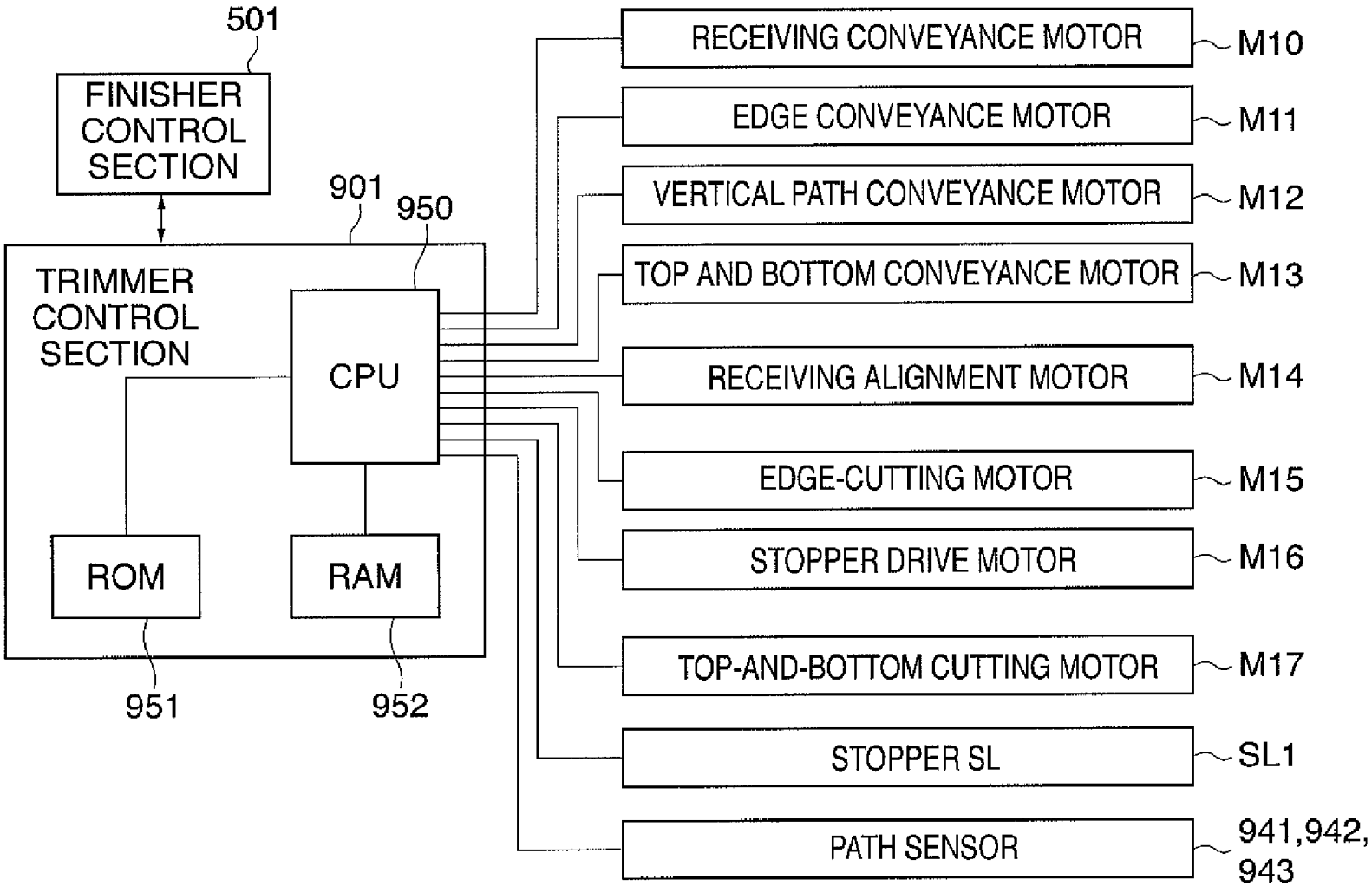
FIG. 10 is a block diagram of a trimmer control section and components connected thereto.

FIG. 10 is a block diagram of a trimmer control section 901 and components connected thereto. The trimmer control section 901 is comprised of a CPU 950, a ROM 951, and a RAM 952. The CPU 950 is connected to various motors M10 to M17, a stopper solenoid (SL) SL1, path sensors 941, 942, and 943, and so forth.

The trimmer control section 901 performs communication with the finisher control section 501 provided within the finisher 500 via a communication IC, not shown, to exchange data therewith. Then, according to instructions from the finisher control section 501, the trimmer control section 901 executes various programs stored in the ROM 951 to control the trimmer 900.

The conveyor belts 902*a* and 902*b* are connected to a receiver conveyor motor M10 so as to be driven thereby. The conveyor belts 903*a* and 903*b* are connected to an edge conveyor motor M11 so as to be driven thereby. The conveyor belts 904*a* and 904*b* are connected to a vertical path conveyor motor M12 so as to be driven thereby. The conveyor belts 905*a* and 905*b* are connected to a top-and-bottom conveyor motor M13 so as to be driven thereby. The motors M10 to M13 are all implemented by stepper motors.

Further, the front-side aligning member 910*a* and the rear-side aligning member 910*b* are connected to a receiver aligning motor M14 so as to be driven thereby such that they are symmetrically moved toward the center when the motor M14 performs normal rotation and outward when the same performs reverse rotation.

The upper edge-cutting blade 912*a* is connected to an edge-cutting motor M15, and is driven in an upward or downward motion by normal or reverse rotation of the edge-cutting motor M15. Load on the edge-cutting motor M15 varies with the number of sheets to be cut and the thickness of each sheet, and hence the edge-cutting motor M15 is implemented by a DC motor.

The edge-cutting stopper 911 is connected to a stopper moving motor M16, and has its position controlled by the stopper/moving motor M16 by being moved in the conveying direction. The stopper moving motor M16 is implemented by a stepper motor. Further, the edge-cutting stopper 911 is driven for an upward or downward motion by the stopper solenoid SL1.

The upper top-and-bottom cutting blade 921*a* is connected to a top-and-blade cutting motor 17, and is driven in an upward or downward motion by normal or reverse rotation of the top-and-bottom cutting motor 17, similarly to the upper edge-cutting blade 912*a*.

Figure 11:
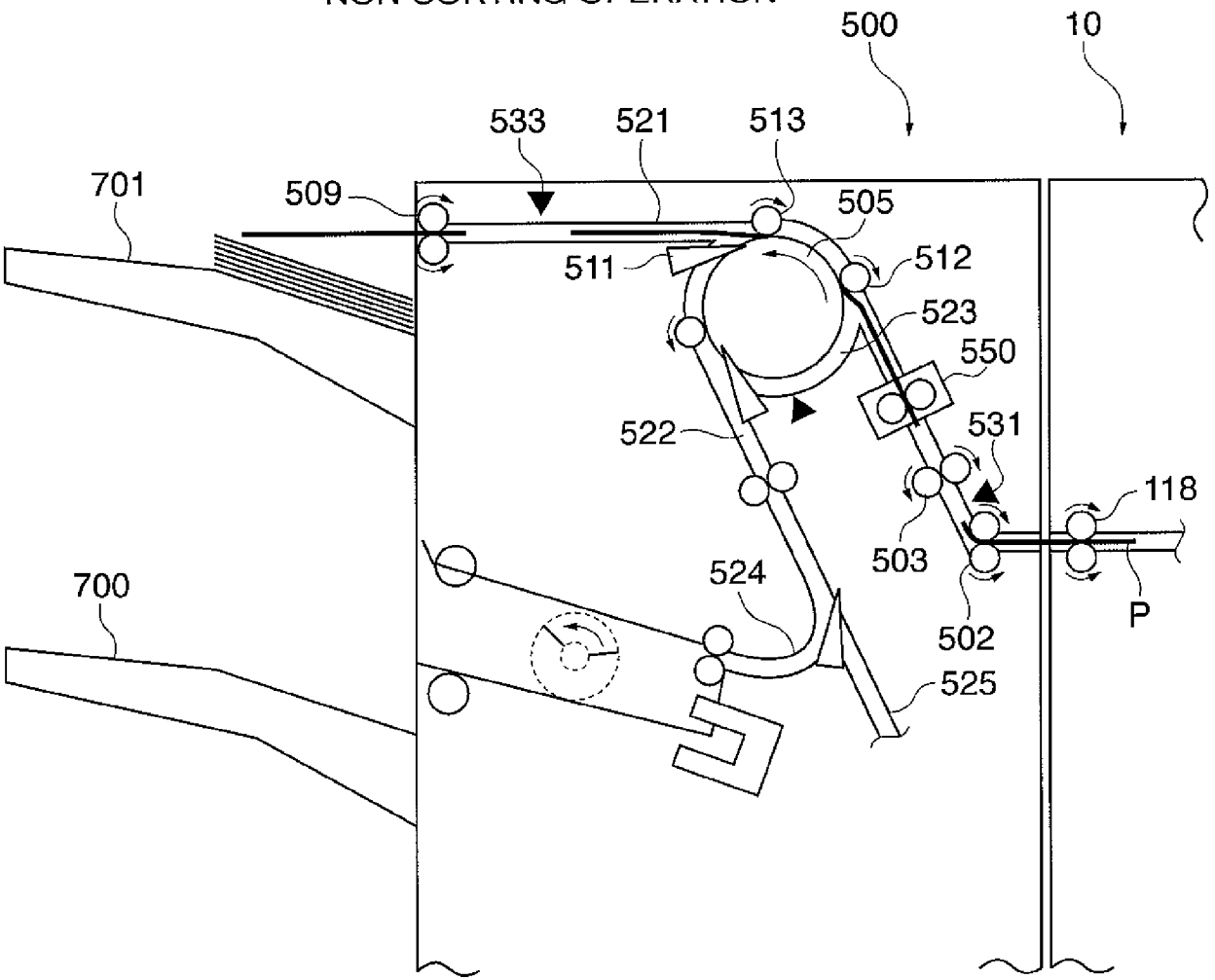
FIG. 11 is a view useful in explaining a flow of sheets in a non-sorting mode.

Now, a description will be given of a flow of sheets in the finisher 500, in association with each of the non-sorting mode, the sorting mode, and the bookbinding mode. FIG. 11 is a view useful in explaining a flow of sheets in the non-sorting mode. When the user designates the non-sorting mode for the sheet discharge mode as one of the post-processing modes, the inlet roller pair 502, the conveying roller pair 503, and the buffer roller 505 are driven for rotation, whereby a sheet P discharged from the image forming apparatus 10 is taken into the finisher 500 and is conveyed.

The switching flapper 511 is driven by a solenoid, not shown, so that the sheet P is conveyed to the non-sorting path 521. Then, when the trailing edge of the sheet P is detected by the sheet discharge sensor 533, the discharge roller pair 509 is rotated at a suitable conveyance speed for stacking sheets on the sample tray 701, whereby the sheet P is discharged onto the sample tray 701.

Figure 12:
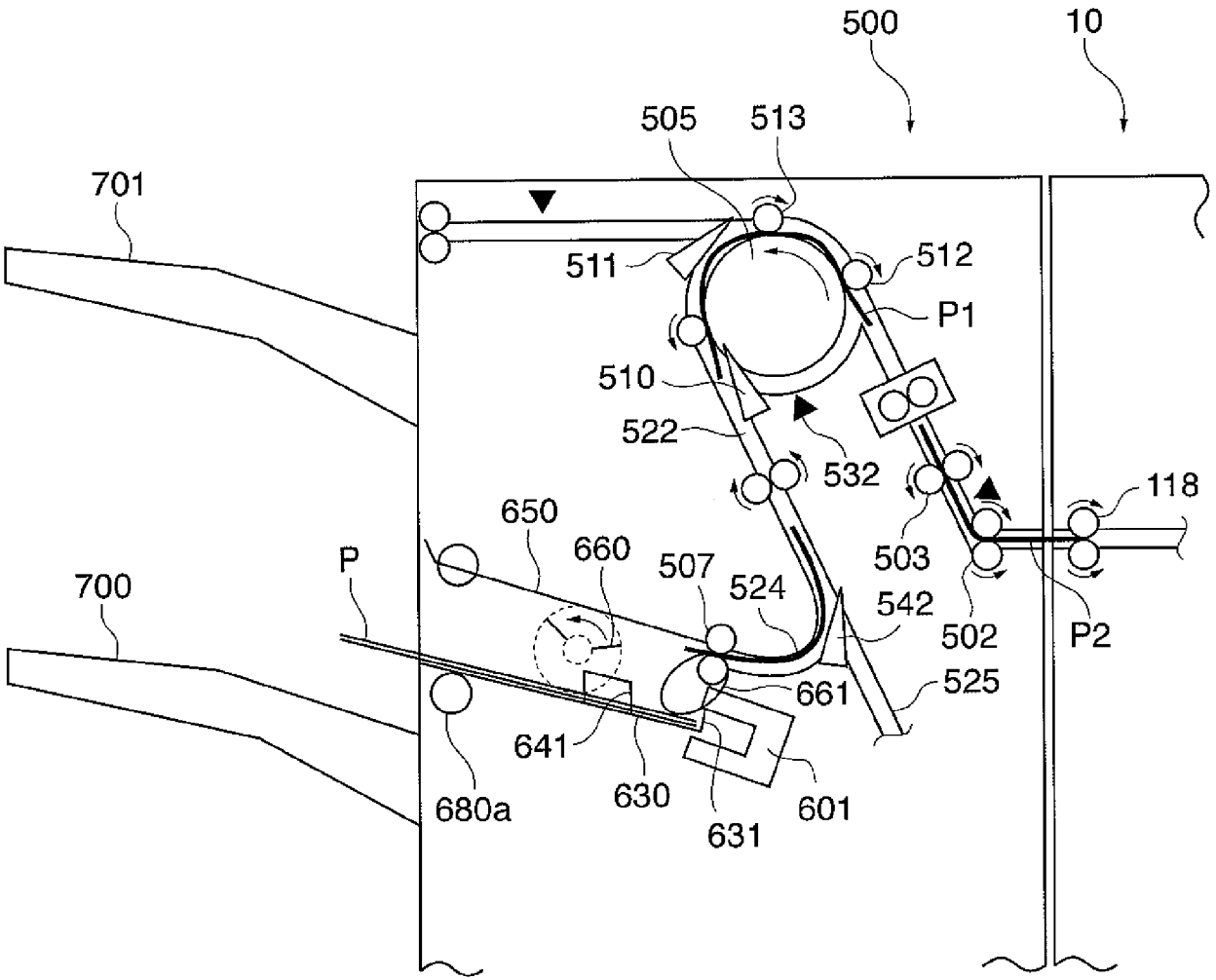
FIG. 12 is a view useful in explaining a flow of sheets in a sorting mode.
Figure 13:
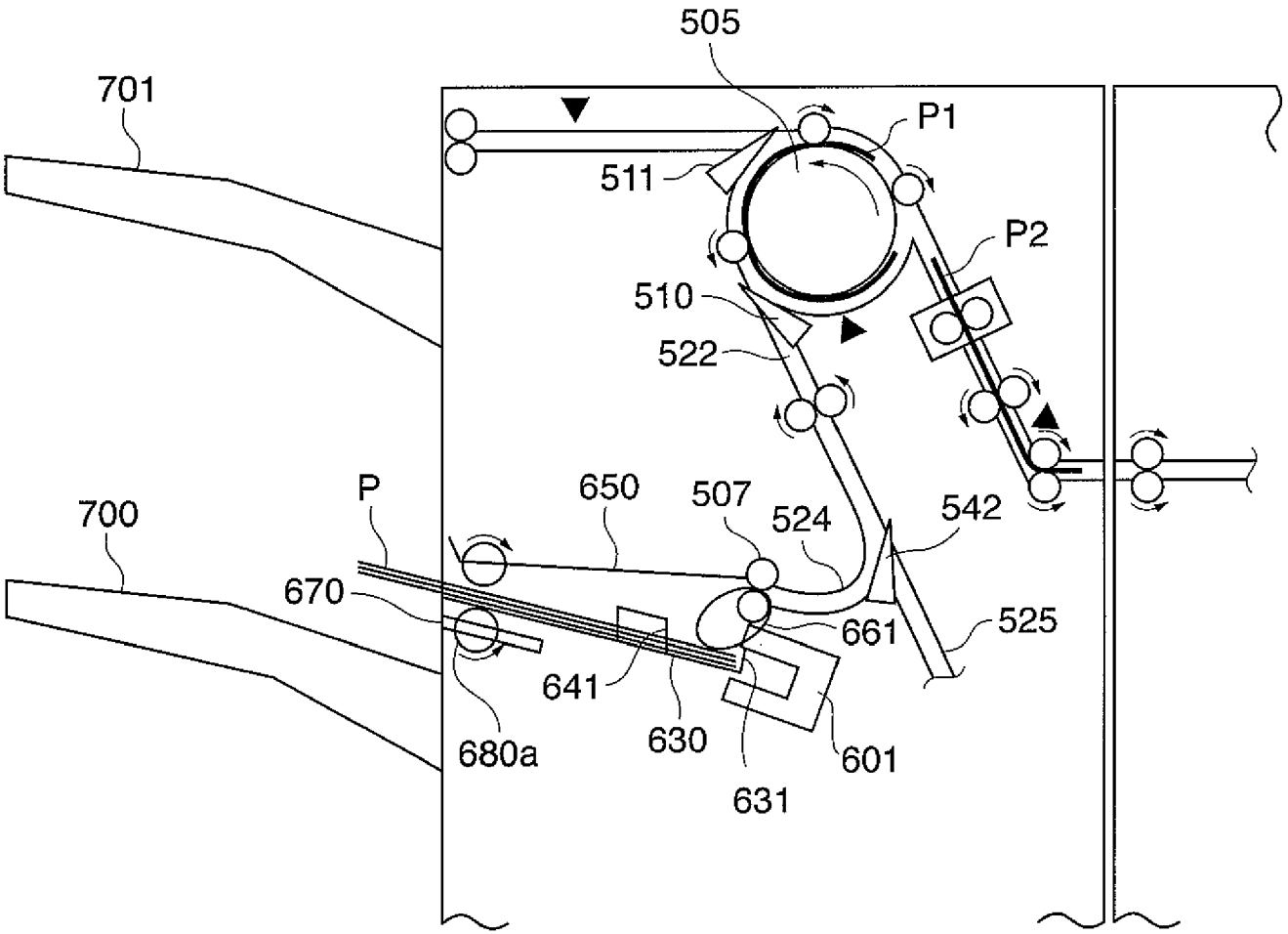
FIG. 13 is a view useful in explaining a flow of sheets in the sorting mode, which shows a state following a state of FIG. 12.

FIGS. 12 and 13 are views useful in explaining a flow of sheets in the sorting mode. When the user designates the sorting mode, the inlet roller pair 502, the conveying roller pair 503, and the buffer roller 505 are driven for rotation, whereby sheets P discharged from the image forming apparatus are taken into the finisher 500 and are conveyed therein. The switching flappers 510 and 511 are stationary at respective positions indicated in FIG. 12, whereby each sheet P is guided into the sorting path 522.

The sheet P guided into the sorting path 522 is guided by the switching flapper 542 into the sorting discharge path 524, and is discharged by the conveying roller pair 507 onto the processing tray 630. At this time of discharge, an auxiliary tray 670 protruding upward prevents the sheet discharged from the conveying roller pair 507 from drooping or erroneously returning, and improves the alignment of sheets on the processing tray 630.

The sheet P discharged onto the processing tray 630 starts to be moved toward a stopper 631 on the processing tray 630 by its own weight. The movement of the sheet P is assisted by assist members, such as a paddle 660 and a return belt 661. After the sheet P has its trailing end abut against the stopper 631 to stop thereat, the discharged sheets are aligned by the alignment members 641. Thereafter, a bundle discharge operation is carried out by sandwiching the bundle of sheets P between the discharge rollers 680*a* and 680*b*, to discharge the sheet bundle P onto the stack tray 700.

Each sheet bundle is discharged from the processing tray 630, and is set in a state aligned by the alignment members 641. Thus, the sheet bundles are stacked on the stack tray 700 one upon another in such a manner that the leading page of each sheet bundle is placed at the bottom of the sheet bundle, with its image-formed surface facing downward, and the following pages sequentially stacked on the leading page in page order.

A description will be given of how sheets (second copy) are conveyed during a time period from the start of taking-in of the sheets P (first copy) to the discharge of the same as a sheet bundle. FIGS. 14, 15, 16 and 17 are views useful in explaining a flow of sheets during the operation of sorting the second sheet bundle.

Figure 14:
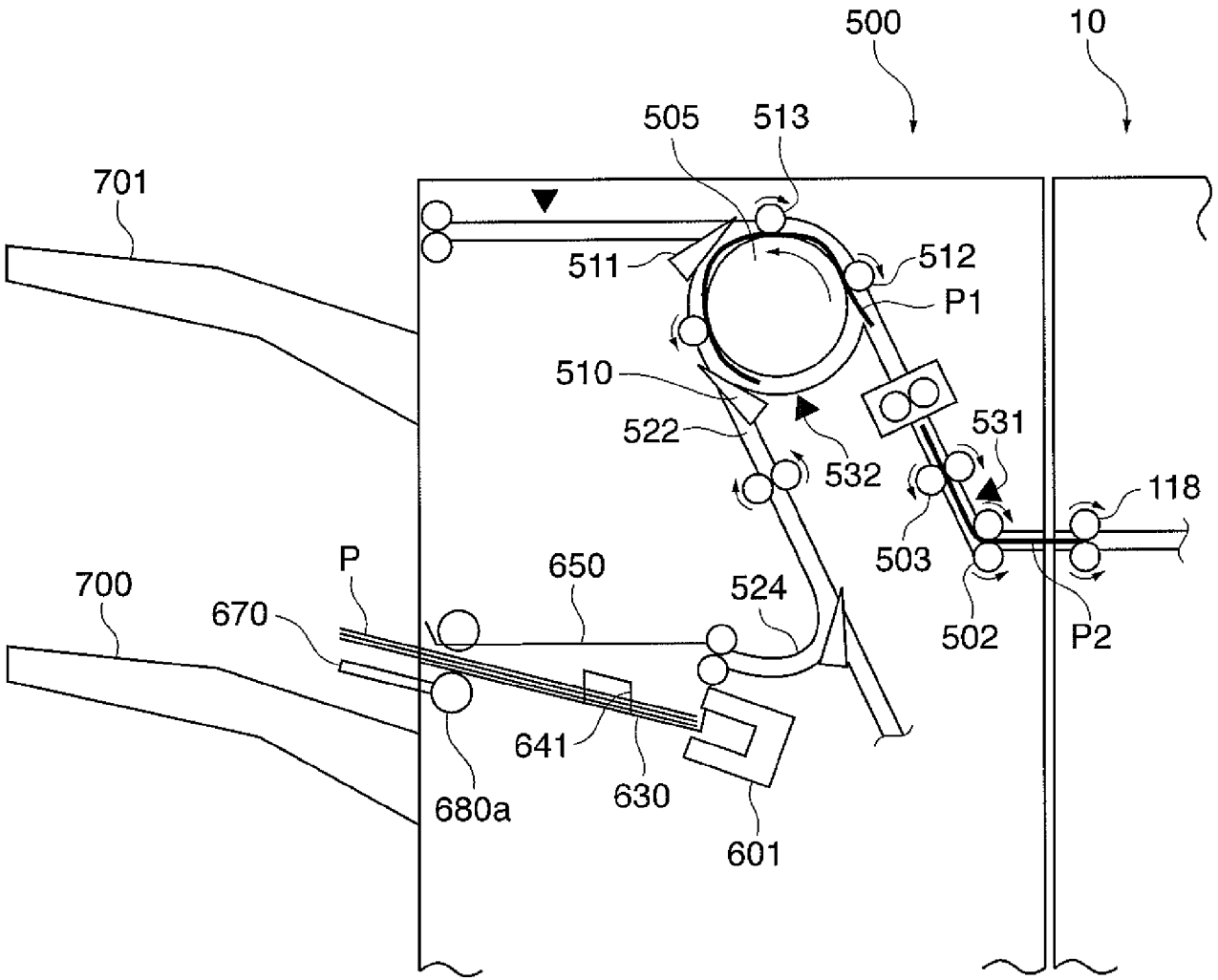
FIG. 14 is a view useful in explaining a flow of sheets of a second bundle in the sorting mode.
Figure 15:
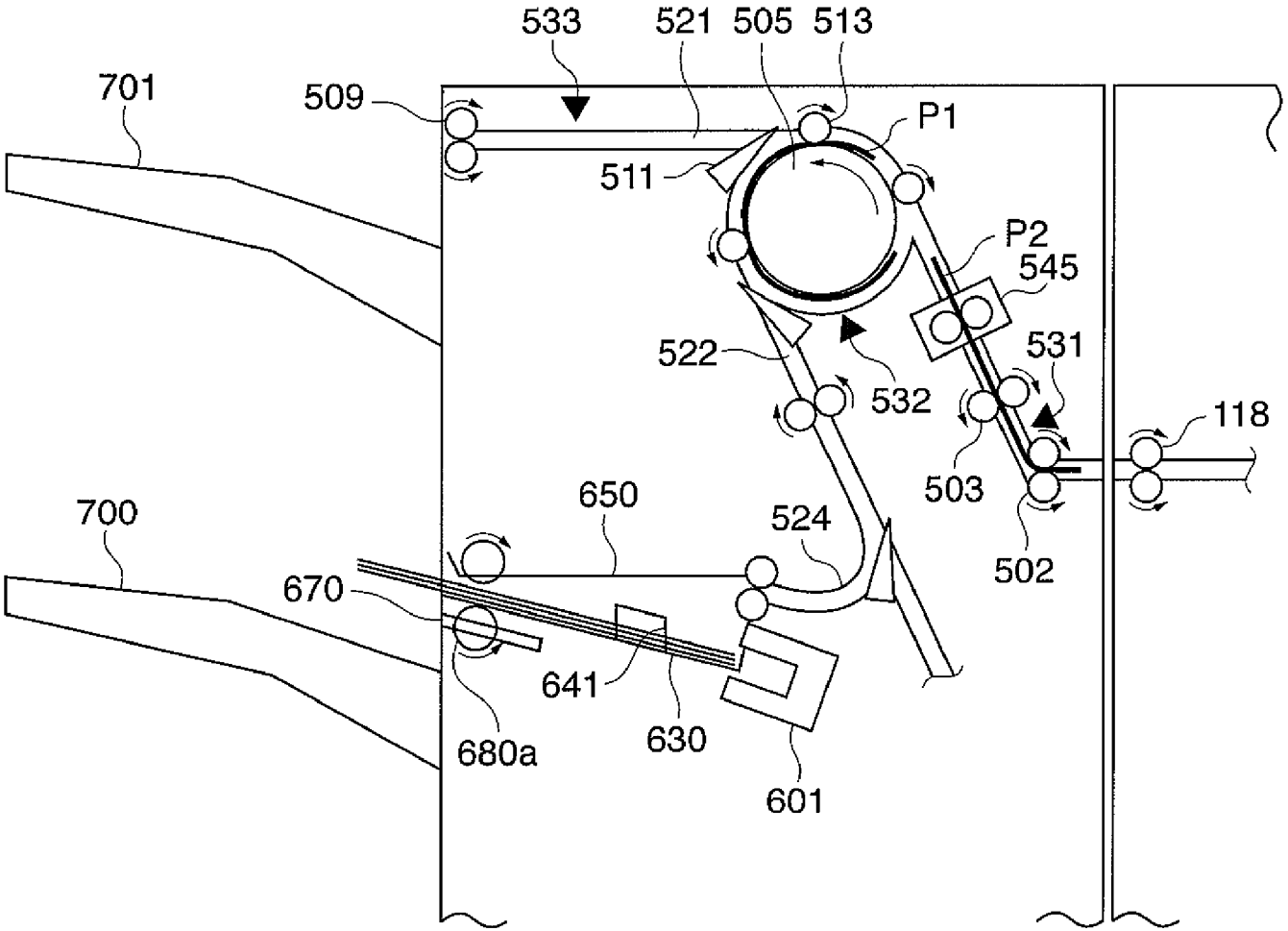
FIG. 15 is a view useful in explaining the flow of sheets of the second bundle in the sorting mode, which shows a state following the state of FIG. 14.
Figure 16:
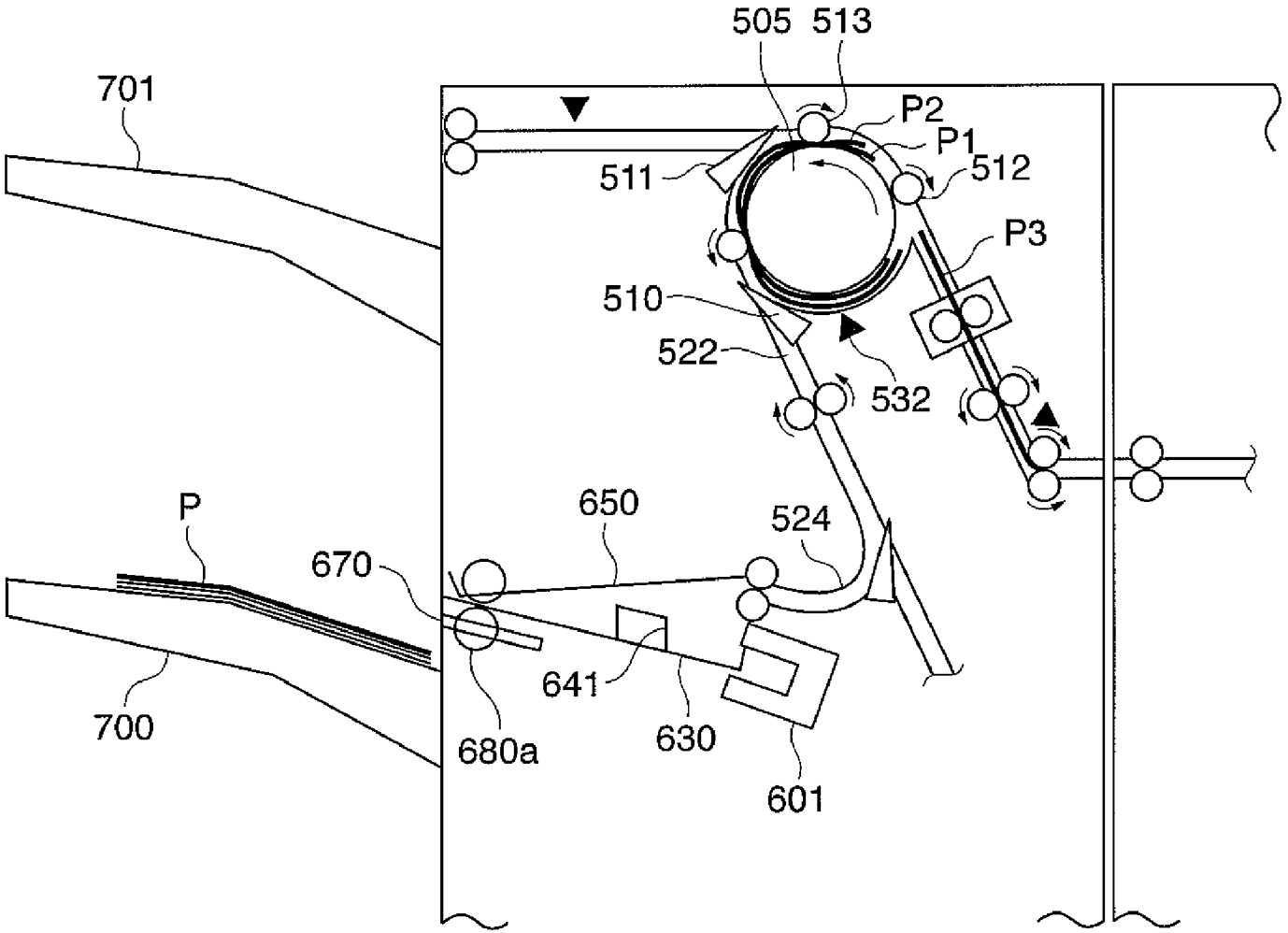
FIG. 16 is a view useful in explaining the flow of sheets of the second bundle in the sorting mode, which shows a state following the state of FIG. 15.

When discharged from the image forming apparatus 10, a sheet P1 as a first page of the second sheet bundle is wound around the buffer roller 505 by the switching operation of the switching flapper 510 (see FIG. 14). The buffer roller 505 is stopped when the sheet P1 is conveyed by a predetermined distance from the buffer path sensor 532.

When the leading edge of a sheet P2 as a second page is advanced from the inlet sensor 531 by a predetermined distance (see FIG. 15), the buffer roller 505 starts to be rotated, whereby the sheet P2 is laid over the sheet P1. The sheets P1 and P2 are conveyed to the buffer path 532 again (see FIG. 16), and have the following sheet P3 laid thereover.

Figure 17:
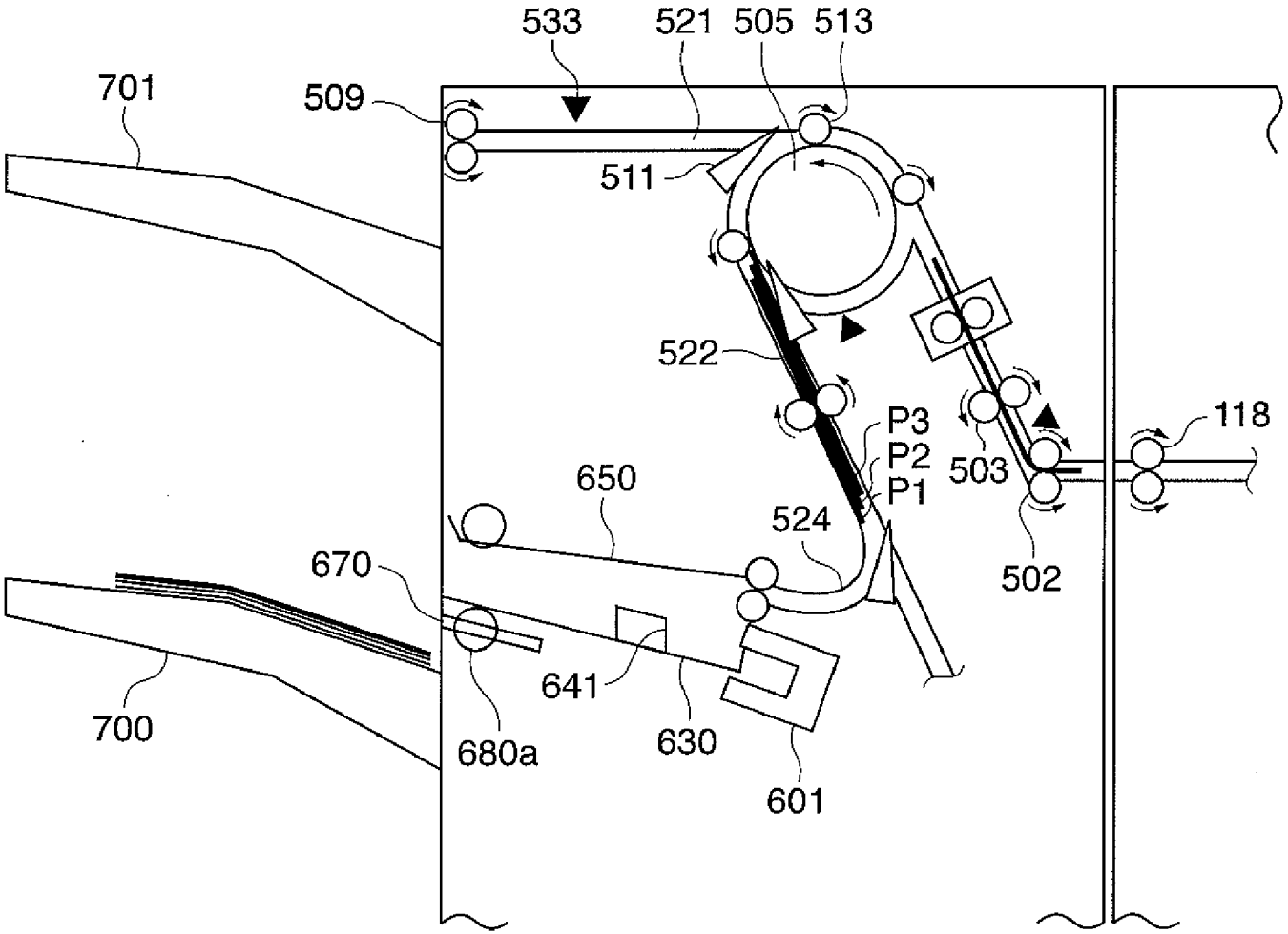
FIG. 17 is a view useful in explaining the flow of sheets of the second bundle in the sorting mode, which shows a state following the state of FIG. 16.

The sheets P1, P2, and P3 wound around the buffer roller 505 are peeled off the buffer roller 505 by the switching operation of the switching flapper 510, and is conveyed as a three-sheet bundle P into the sorting path 522 (see FIG. 17). At this time point, the bundle discharging operation of the sheet bundle P placed on the processing tray 630 has been completed, and hence the processing tray 630 is ready for receiving a sheet bundle P discharged anew. The sheet bundle P of three sheets is discharged onto the processing tray 630.

A fourth and following sheets are each discharged onto the processing tray via the sorting path 522 without being conveyed into the buffer path 532 in the same manner as those of the first copy.

As for the following sheet conveying operations, the second sheet bundle starts to be discharged onto the stack tray 700 to carry out the same operations described above, and this process is repeatedly carried out, whereby a predetermined number of sheet bundles are stacked on the stack tray 700. It should be noted that in the present embodiment, three sheets are laid over each other; this is not limitative, but two sheets or four or more sheets may be laid over each other.

Figure 18:
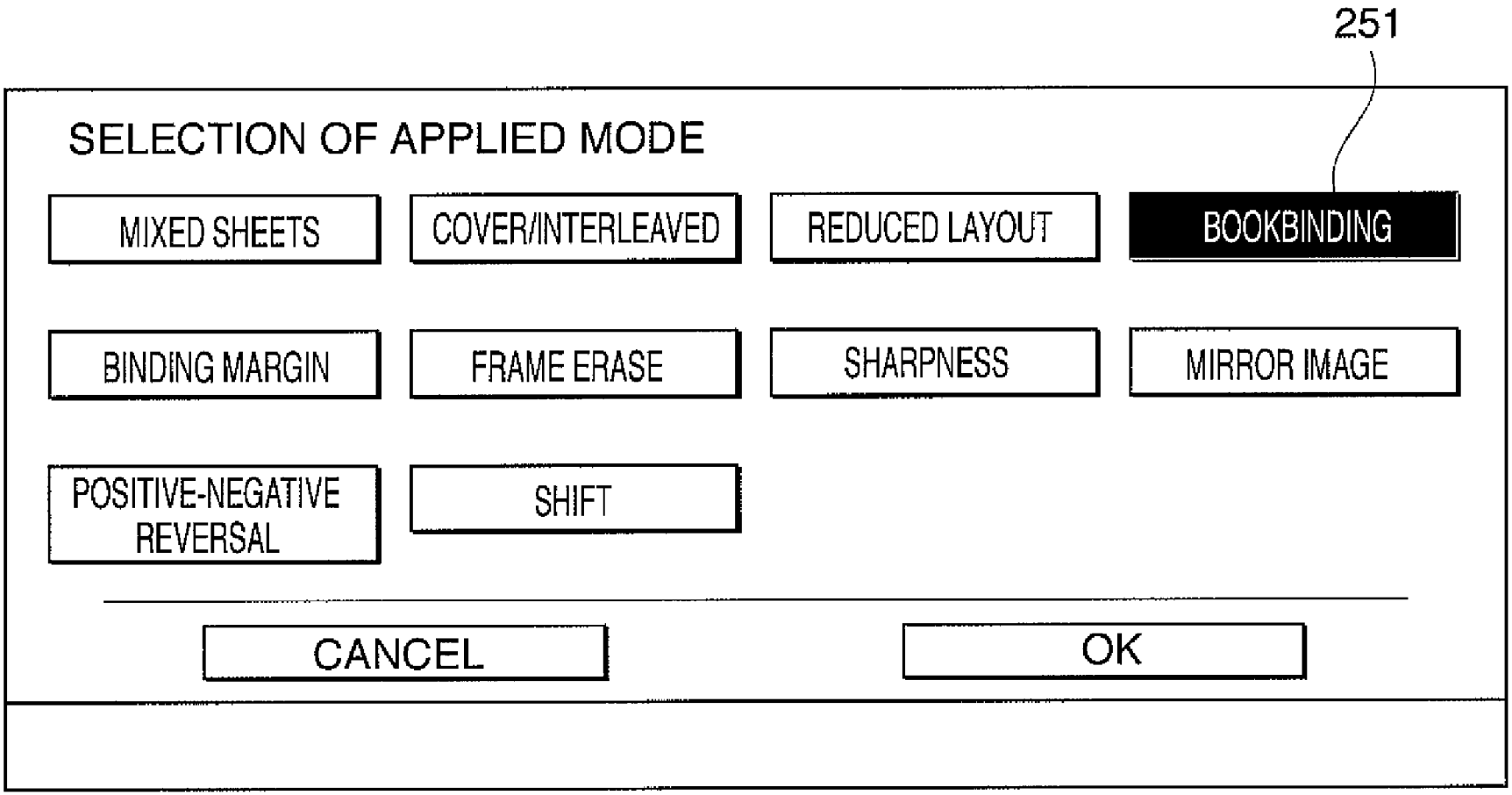
FIG. 18 is a view of an applied mode selection screen displayed on a display.

FIG. 18 is a view of an applied mode selection screen displayed on the display 420. The applied mode selection screen is for selecting one of various modes, and is displayed by being switched from the initial screen when "applied mode" as a soft key displayed on the initial screen (see FIG. 3) is selected. On the applied mode selection screen, it is possible to select any of the keys of "mixed sheets", "cover/interleaved", "reduced layout", "bookbinding", "binding margin", "frame erase", "sharpness", "mirror image", "positive-negative reversal", and "shift".

Figure 19:
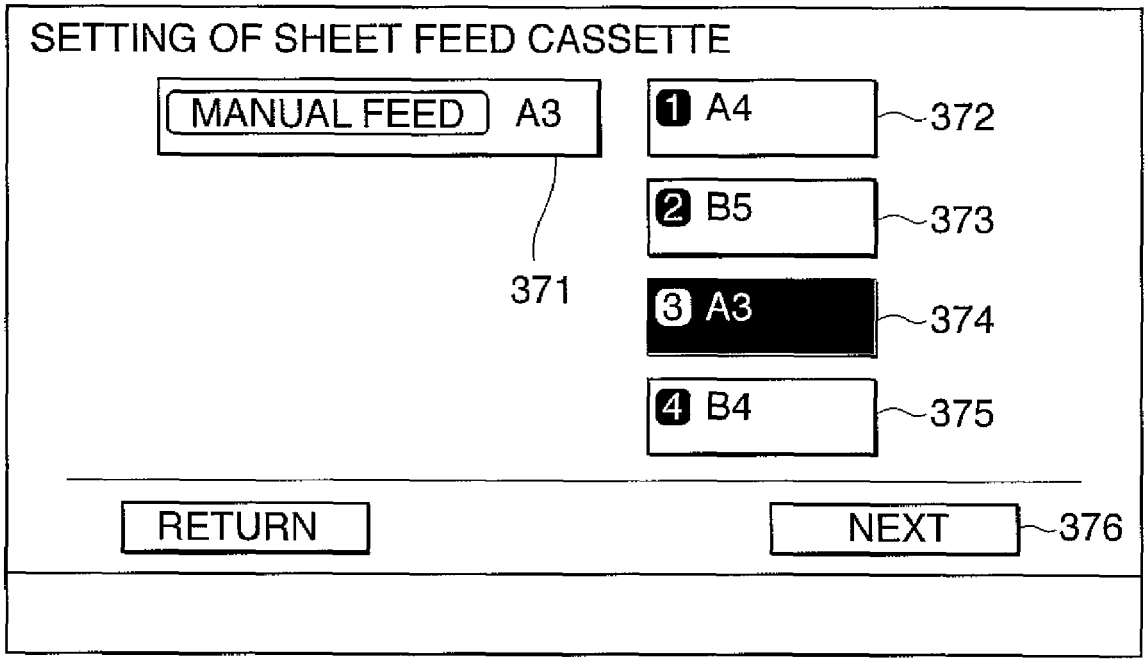
FIG. 19 is a view of a sheet cassette-setting screen.
Figure 20:
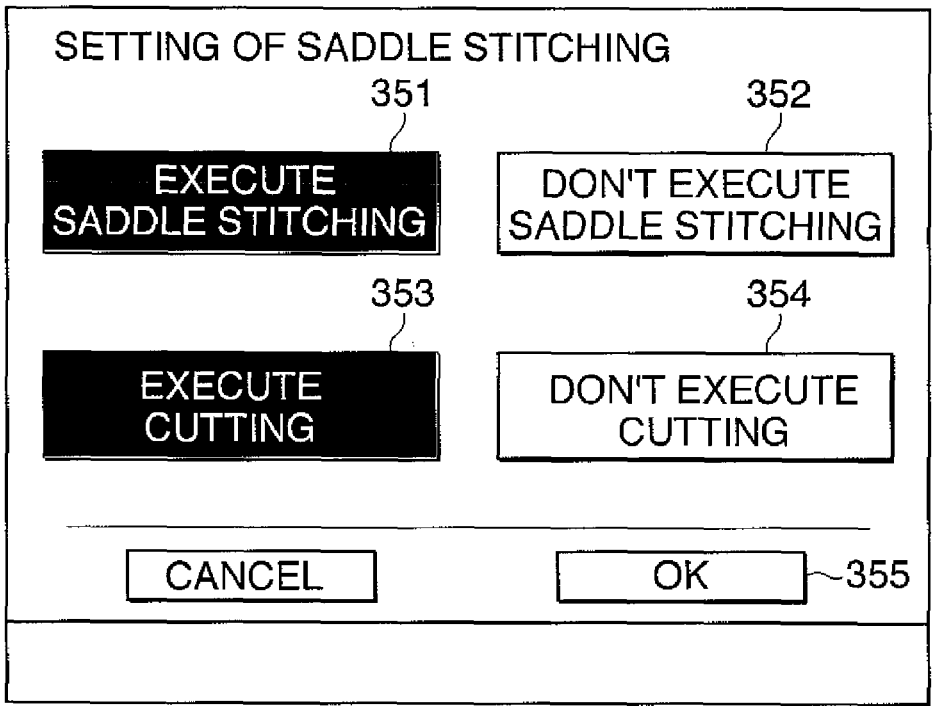
FIG. 20 is a view of a saddle stitching and cutting-setting screen.

When the "bookbinding" key 251 is selected, the bookbinding mode is started, and keys are displayed which enable the user to select one of the cassettes (sheet cassettes) associated therewith and accommodating recording sheets to be output. FIG. 19 is a view of a sheet cassette-setting screen. On the sheet cassette-setting screen, it is possible to select any of a "manual A3" feed key, an "A4" feed key 372, a "B5" key 373, an "A3" feed key 374, and a "B4" key 375. After selecting a key for a cassette containing sheets having a selected size from this screen, if a "next" key 376 is selected, the screen is shifted to one for setting processing on the sheet bundle to be bookbound (whether or not to execute saddle stitching). FIG. 20 is a view of this screen, i.e., a saddle stitching and cutting-setting screen. At this time, if the bookbinding mode has been selected, at least folding of a sheet bundle at its center (hereinafter referred to as "center folding") is executed, but the user can select whether or not to execute saddle stitching. On the saddle stitching setting screen, an "execute saddle stitching" key 351 or a "don't execute saddle stitching" key 352 is selected. In the illustrated example, the "don't execute saddle stitching" is selected.

Further, independently of saddle stitching, it is possible to select whether or not to execute cutting. Irrespective of how the saddle stitching setting is set, if a "don't execute cutting" key 354 is selected and an "OK" key 355 is depressed, the setting operation is terminated. Then, the process returns to the initial screen (see FIG. 3), and waits for the start key 402 to be depressed to start image-forming and post-processing operations.

Figure 21:
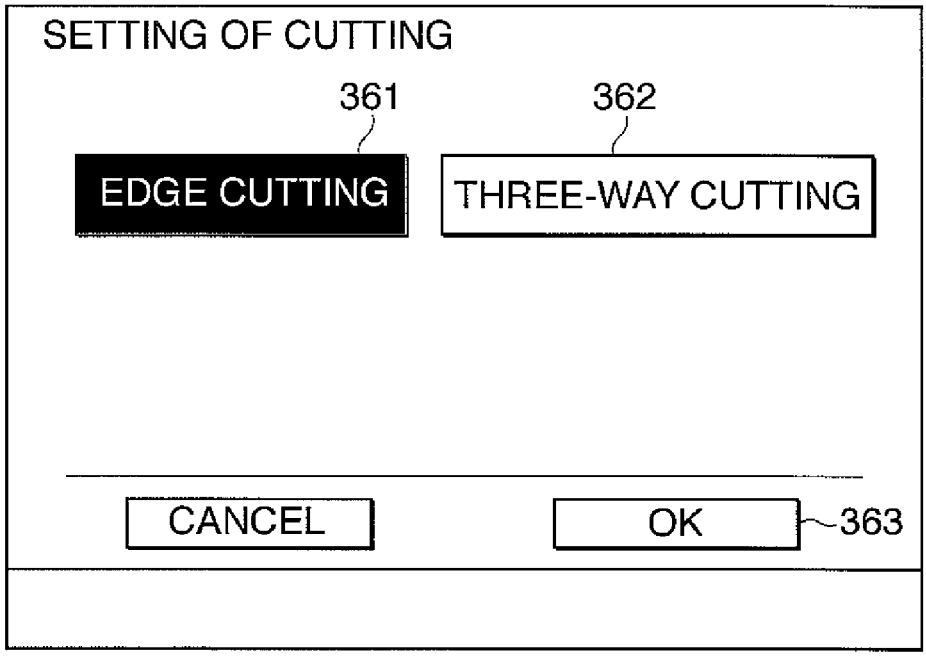
FIG. 21 is a view of a cutting-setting screen.

On the other hand, irrespective of how the saddle stitching is set, if an "execute cutting" key 353 is selected, and the "OK" key 355 is depressed, a cutting-setting screen is displayed. FIG. 21 is a view of the cutting-setting screen. In this setting screen, it is selected whether to execute edge cutting or to execute both edge cutting and top-and-bottom cutting (three-way cutting).

Figure 22:
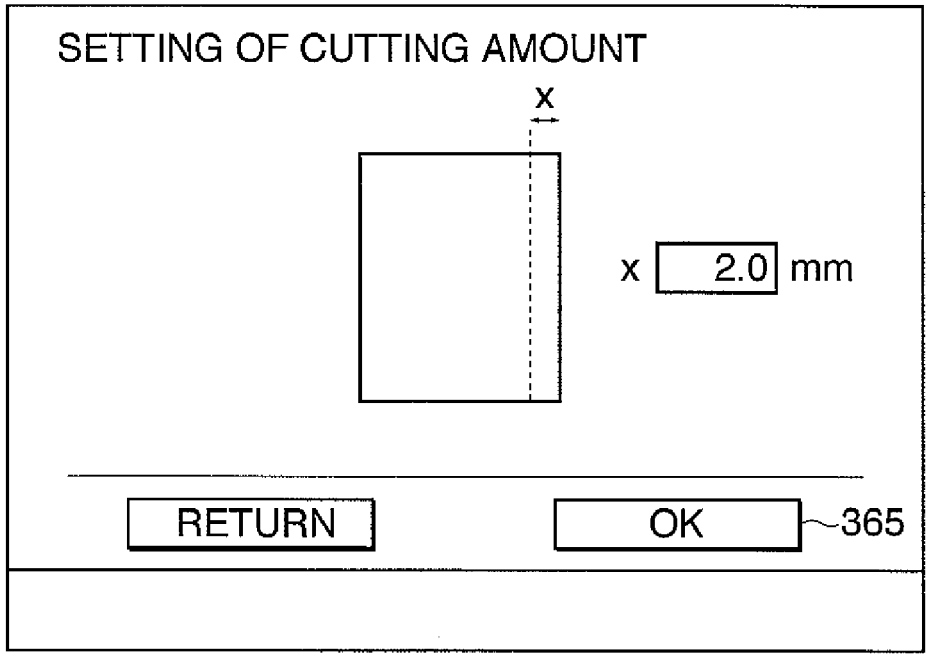
FIG. 22 is a view of a cutting amount-setting screen.

If a "edge cutting" key 361 is selected, and a "OK" key 363 is depressed, a cutting amount-setting screen is displayed. FIG. 22 is a view of the cutting amount-setting screen. This setting screen is for setting a cutting length x from a sheet end, and it is possible to set the cutting amount to a desired value by the ten-key pad of the operating/display unit 400. After the cutting amount is set, if the "OK" key 365 is depressed, the setting is terminated, and the process returns to the initial setting screen (see FIG. 3).

Figure 23:
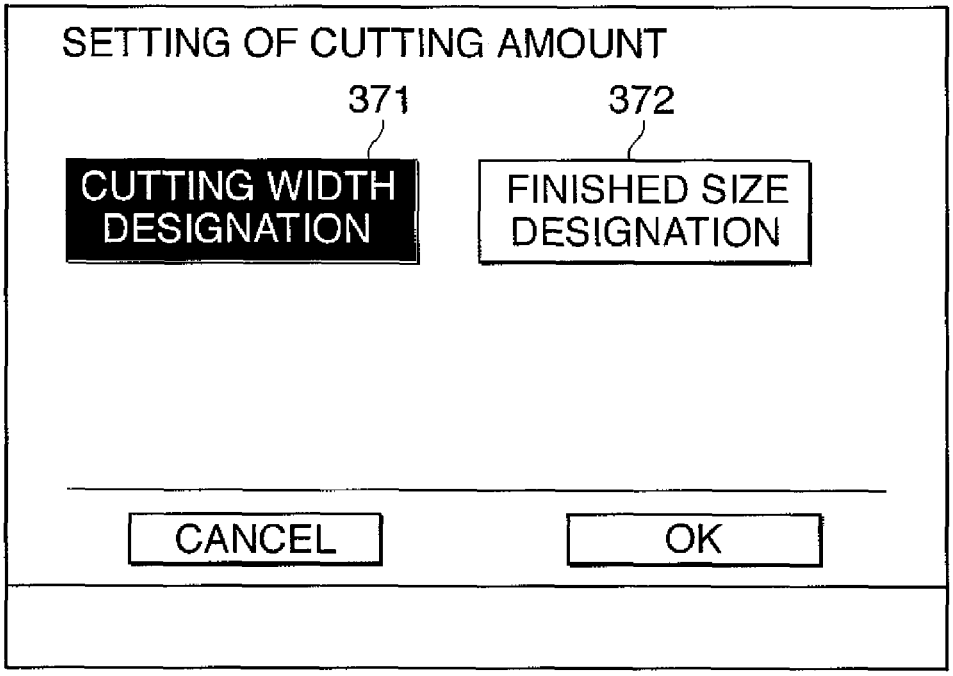
FIG. 23 is a view of a cutting amount-setting screen.

On the other hand, if a "three-way cutting" key 362 is selected and the "OK" key 363 is depressed, a cutting amount-setting screen is displayed. FIG. 23 is a view of the cutting amount-setting screen. On this setting screen, the user is capable of selecting a "cutting width designation" key 371 or a "finished size designation" key 372. In the "cutting width designation", a cutting length (cutting width) from a sheet end is designated, similarly to the case of edge cutting, whereas in the "finished size designation", a sheet size after being subjected to edge cutting and top-and-bottom cutting is set, without requiring the user to care about the cutting length (cutting width).

Figure 24:
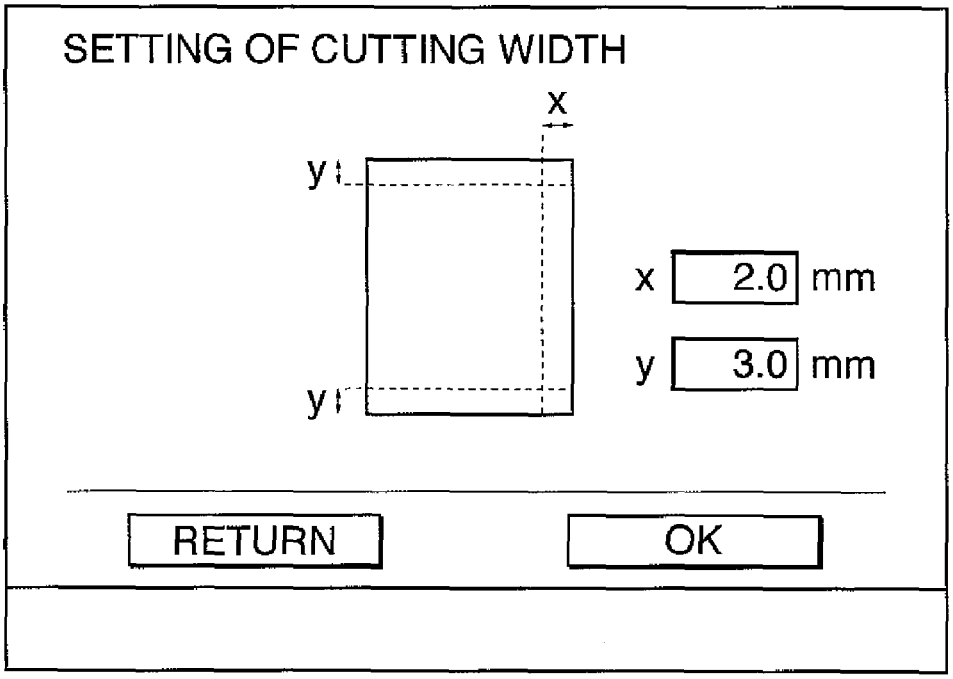
FIG. 24 is a view of a cutting width designation screen displayed when a "cutting width designation" key is selected.
Figure 25:
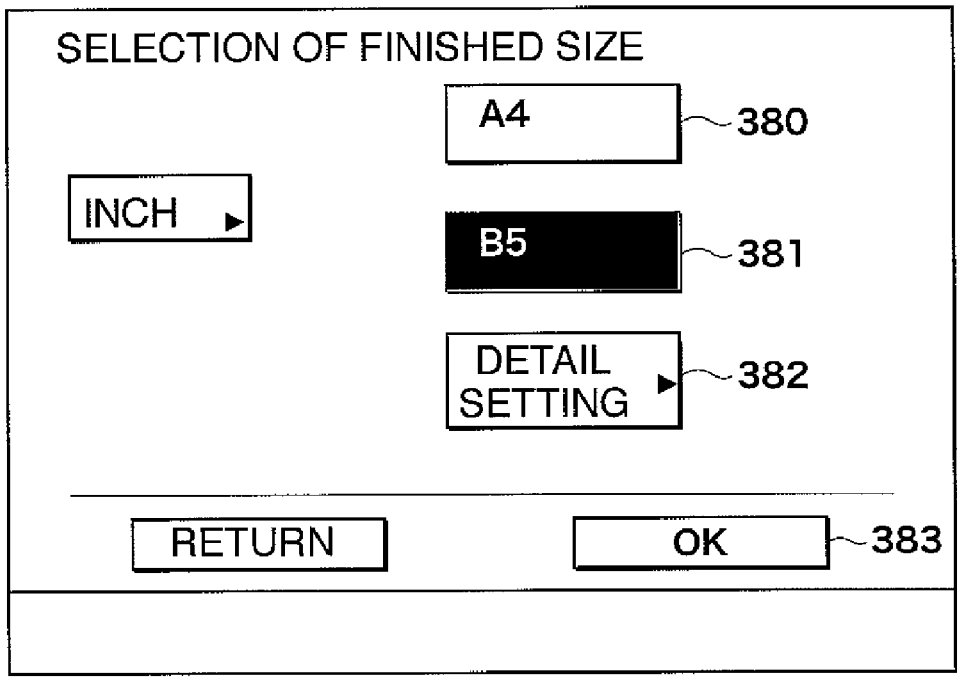
FIG. 25 is a view of a finished size selection screen displayed when a "finished size designation" key is selected.

FIG. 24 is a view of a cutting width-setting screen displayed when the "cutting width designation" key 371 is selected. Similarly to the cutting amount designation for edge cutting, a cutting amount (cutting length) x for an edge side and a cutting amount (cutting length) y for top and bottom sides are entered from the ten-key pad of the operating/display unit 400. FIG. 25 is a finished size selection screen displayed when the "finished size designation" key 372 is selected. From this screen, it is possible to select any of keys 380 and 381 enabling selection of standard sizes (A4, B5, etc.), a "detail setting" key 382 enabling selection of a desired size other than the standard sizes. As the standard sizes, it is possible to switch between an A/B-type sizes and inch-type sizes. If one of the standard sizes is selected and an "OK" key 383 is depressed, the setting is terminated, and the process returns to the initial screen (see FIG. 3).

Figure 26:
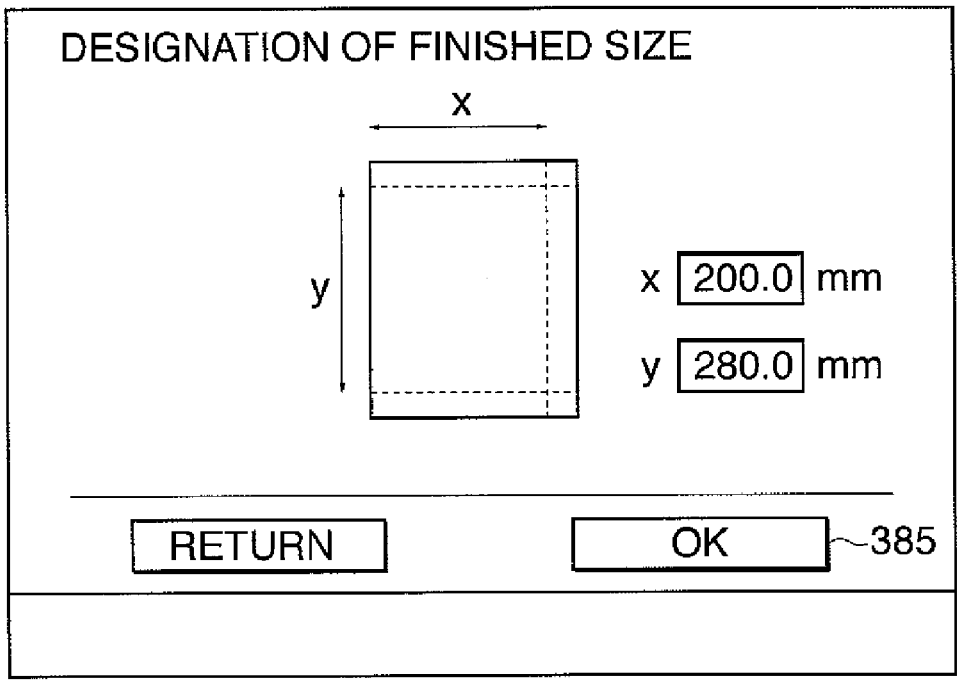
FIG. 26 is a view of a finished size designation screen displayed when a "detailed setting" key is selected.

FIG. 26 is a view of a finished size designation screen displayed when the "detail setting" key 382 is selected. On this setting screen, a finished length x in the direction associated with edge cutting and a finished length y in the direction associated with top-and-bottom cutting are entered from the ten-key pad of the operating/display unit 400. After the entry, if the "OK" key 385 is depressed, the setting is terminated, and the process returns to the initial setting screen (see FIG. 3).

Figure 27:
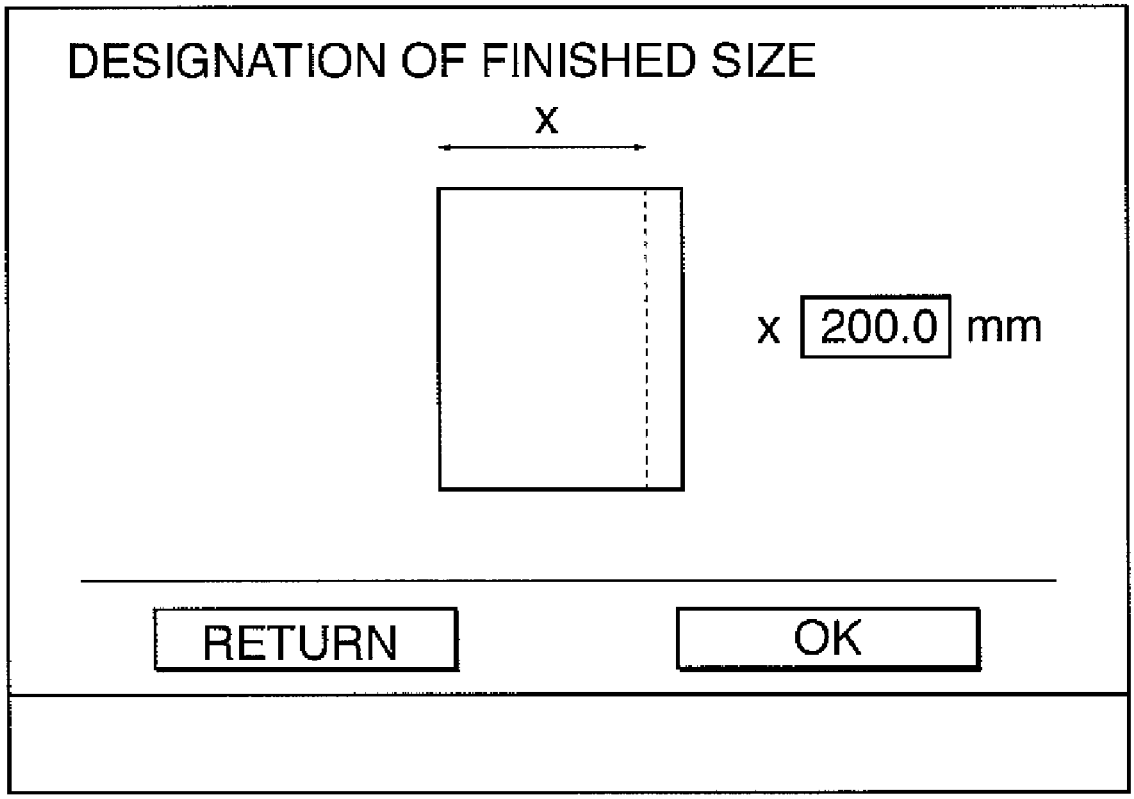
FIG. 27 is a view of a finished size designation screen displayed when the "finished size designation" key is selected.

Although in the above-described embodiment, if edge cutting is selected, the process automatically (preferentially) proceeds to the cutting width designation, this is not limitative, but even when either of edge cutting and three-way cutting is selected, the user may be allowed to select whether to set the cutting width or to set the finished size setting. In this case, when edge cutting is selected on the cutting setting screen (see FIG. 21), the screen is caused to be switched to the cutting amount-setting screen (see FIG. 23), and then, it is switched to a screen selected by the "cutting width designation" key 371 or the "finished size designation" key 372. If the "cutting width designation" key 371 is selected at this time, the cutting amount-setting screen (see FIG. 22) is displayed for setting a cutting length from a sheet end. On the other hand, if the "finished size designation" key 372 is selected, there is displayed a screen (finished size designation screen) for setting a length which a sheet should have after being cut. FIG. 27 is a view of the finished size designation screen displayed when the "finished size designation" key 372 is selected.

FIGS. 28, 29, 30 and 31 are views useful in explaining a flow of sheets in the bookbinding mode. When the user designates the bookbinding mode, the inlet roller pair 502, the conveying roller pair 503, and the buffer roller 505 are driven for rotation, whereby sheets P discharged from the image forming apparatus are taken into the finisher 500 and conveyed therein.

Figure 28:
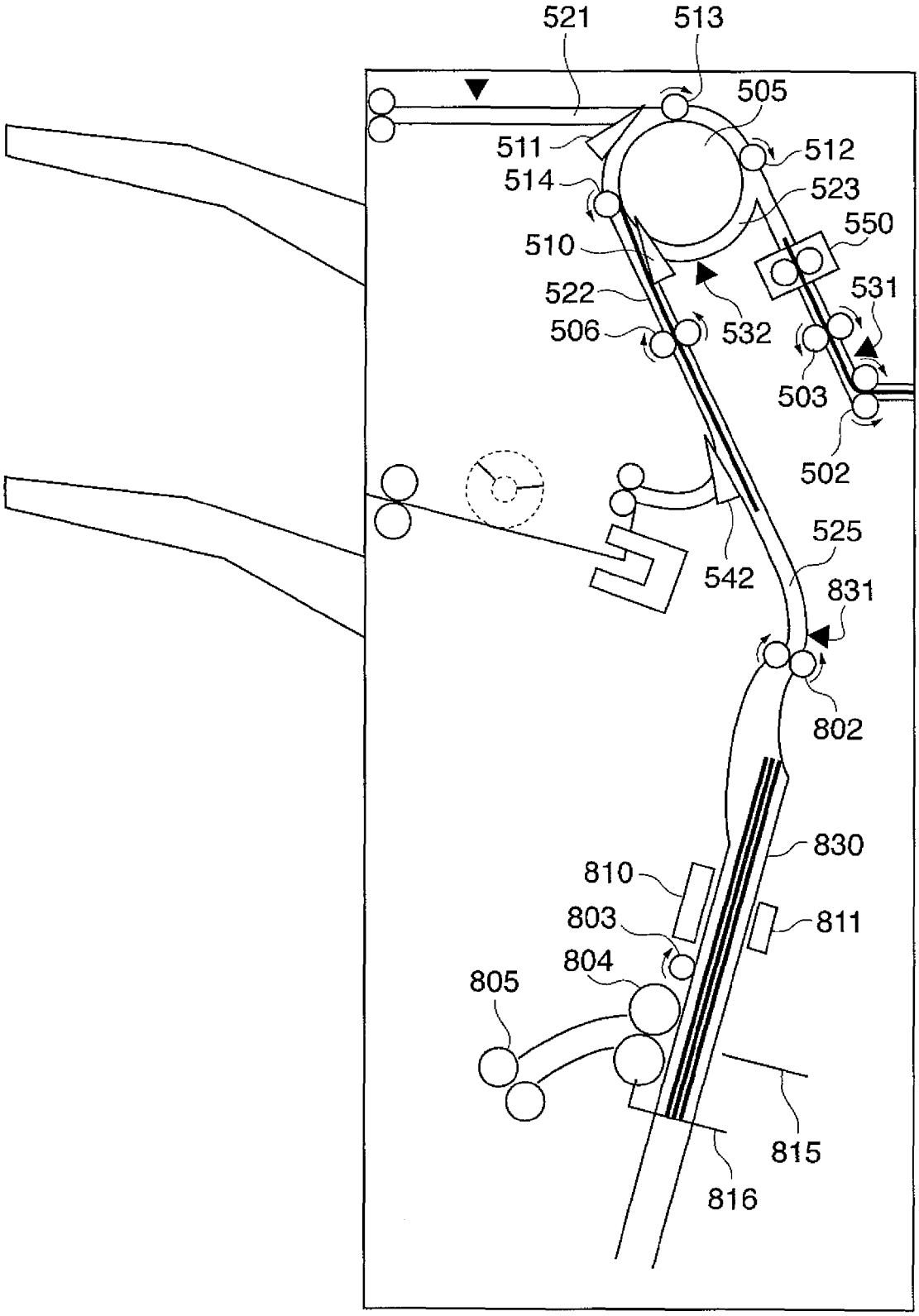
FIG. 28 is a view useful in explaining a flow of sheets in the finisher in a bookbinding mode.
Figure 29:
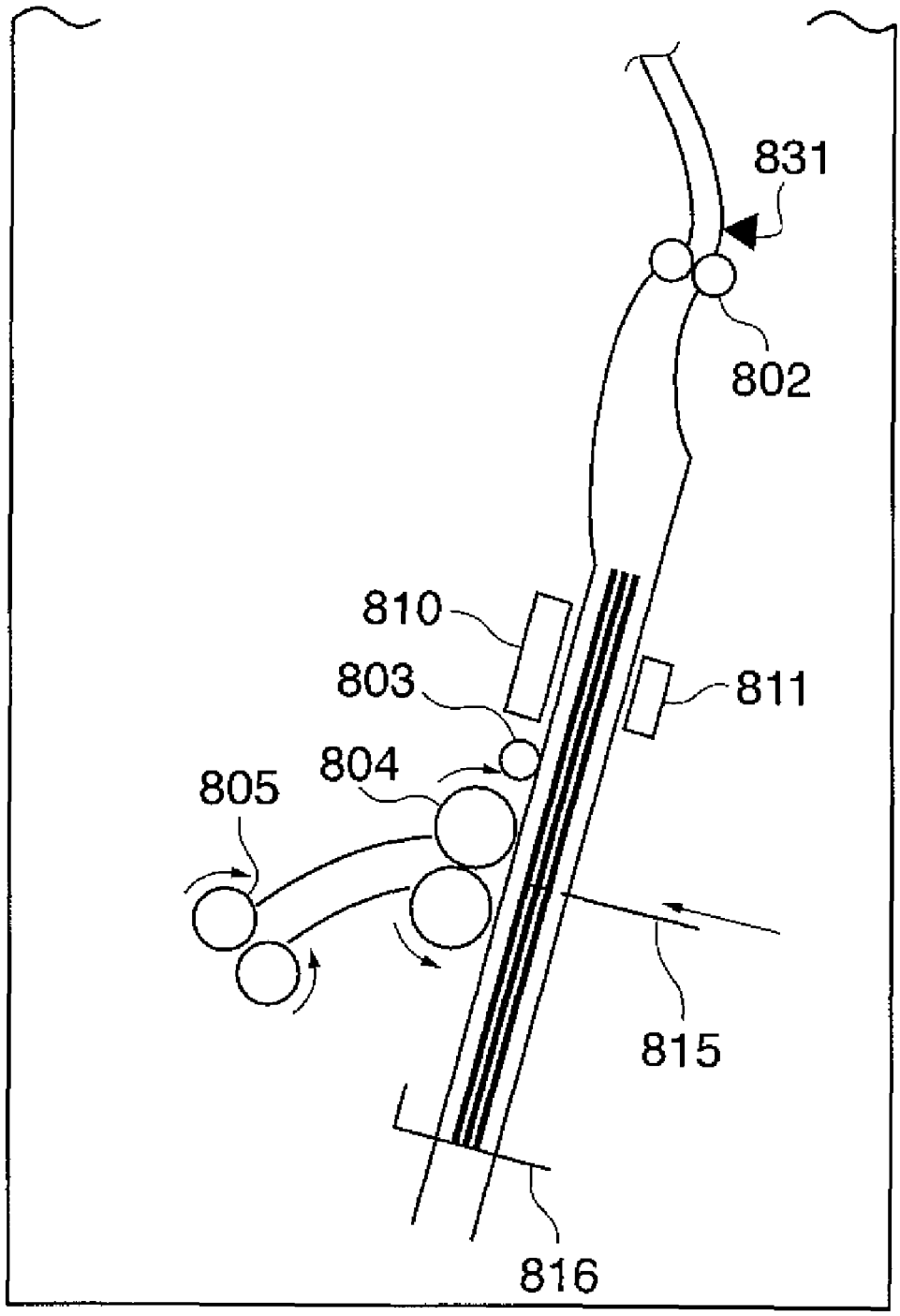
FIG. 29 is a view useful in explaining a flow of sheets in a bookbinding path in the bookbinding mode.
Figure 30:
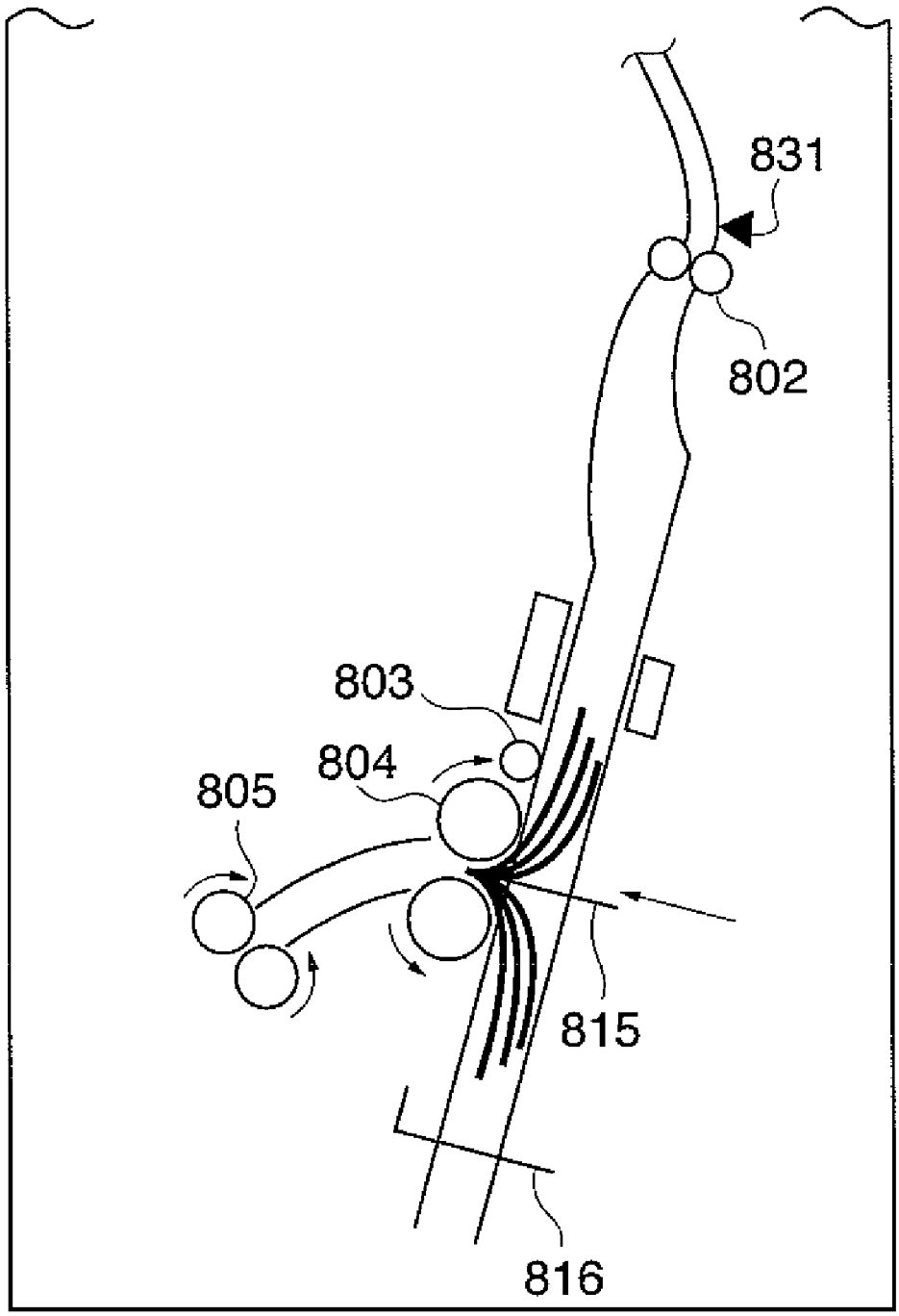
FIG. 30 is a view useful in explaining the flow of sheets in the bookbinding path in the bookbinding mode, which shows a state following a state of FIG. 29.
Figure 31:
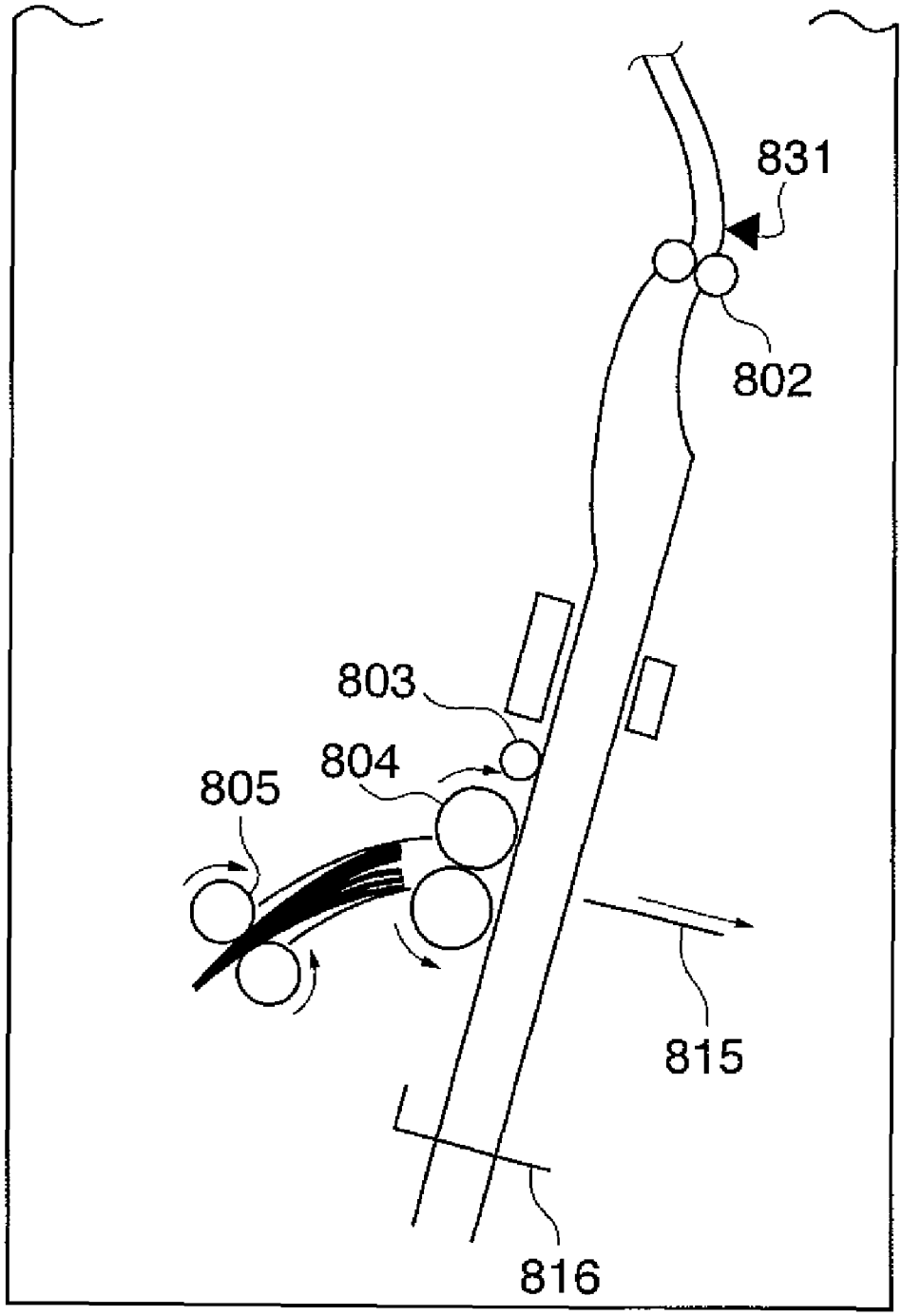
FIG. 31 is a view useful in explaining the flow of sheets in the bookbinding path in the bookbinding mode, which shows a state following a state of FIG. 30.

The switching flappers 510, 511, and 542 are at rest in positions illustrated in FIG. 28, and a sheet P is guided from the sorting path 522 into the bookbinding path 525, and is received into the bookbinding tray 830 by the conveying roller pair 802. The intermediate roller 803 is being driven for rotation, and the leading end of the sheet received into the bookbinding tray 830 is conveyed to a position in contact with the sheet positioning member 816. Here, the position of the sheet positioning member 816 is set such that the center of a sheet bundle received in the bookbinding tray 830 can be stapled by the staplers 810.

When the leading end of the sheet reaches the sheet positioning member 816 to stop thereat, a aligning member, not shown, is moved orthogonally to the sheet conveying direction, whereby sheet aligning is performed.

In the case where the "execute saddle stitching" has been selected during setting of the bookbinding mode, when a predetermined number of sheets are received in an aligned state, the staplers 810 performs the stapling processing on the sheet bundle at the center thereof (hereinafter referred to as "saddle stitching"). In the case where the "don't execute saddle stitching" has been selected during setting of the bookbinding mode, the stapling processing is not performed. It should be noted that in the present embodiment, when "don't execute saddle stitching" is selected, sheets are stacked on a saddle processing tray. In this case, the number of sheets which can be folded is three. In the present embodiment, the saddle processing tray designates the bookbinding tray 830 in a state in which the position of the sheet positioning member 816 is set such that the center of the sheet bundle received in the bookbinding tray 830 is opposed to the folding roller pair 804.

Then, the sheet positioning member 816 is lowered (see FIG. 29) until the stapling position (center) of the sheet bundle becomes the center of the folding roller pair 804. The folding roller pair 804 and the conveying roller pair 805 are driven for rotation and at the same time, the thrusting member 815 is caused to protrude to thrust the sheet bundle between the folding roller pair 804 (see FIG. 30). The sheet bundle is conveyed downstream while being folded, and is caused to discharge into the trimmer by the conveying roller pair 805.

Figure 32:
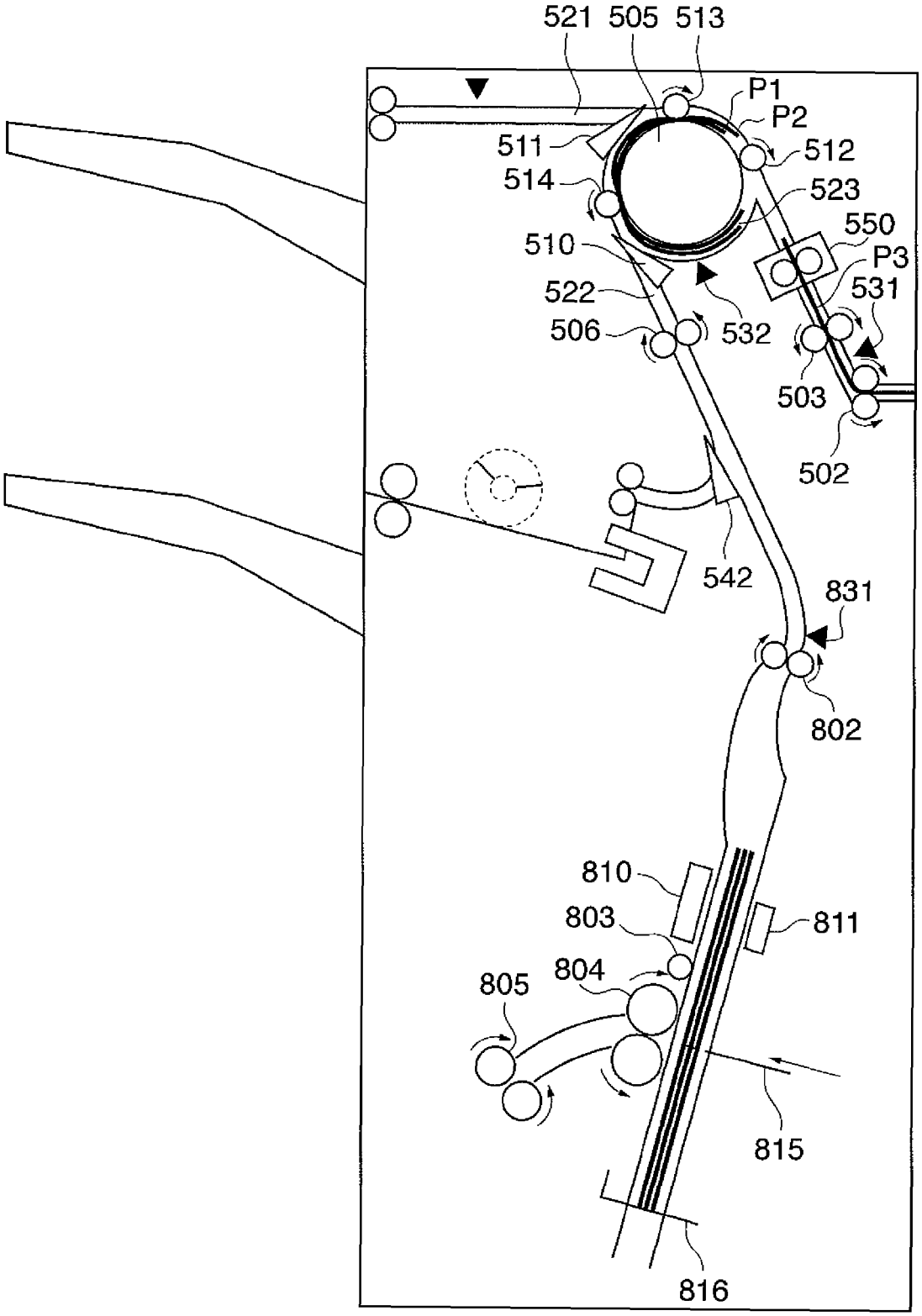
FIG. 32 is a view useful in explaining a flow of sheets of a second bundle in the bookbinding mode.
Figure 33:
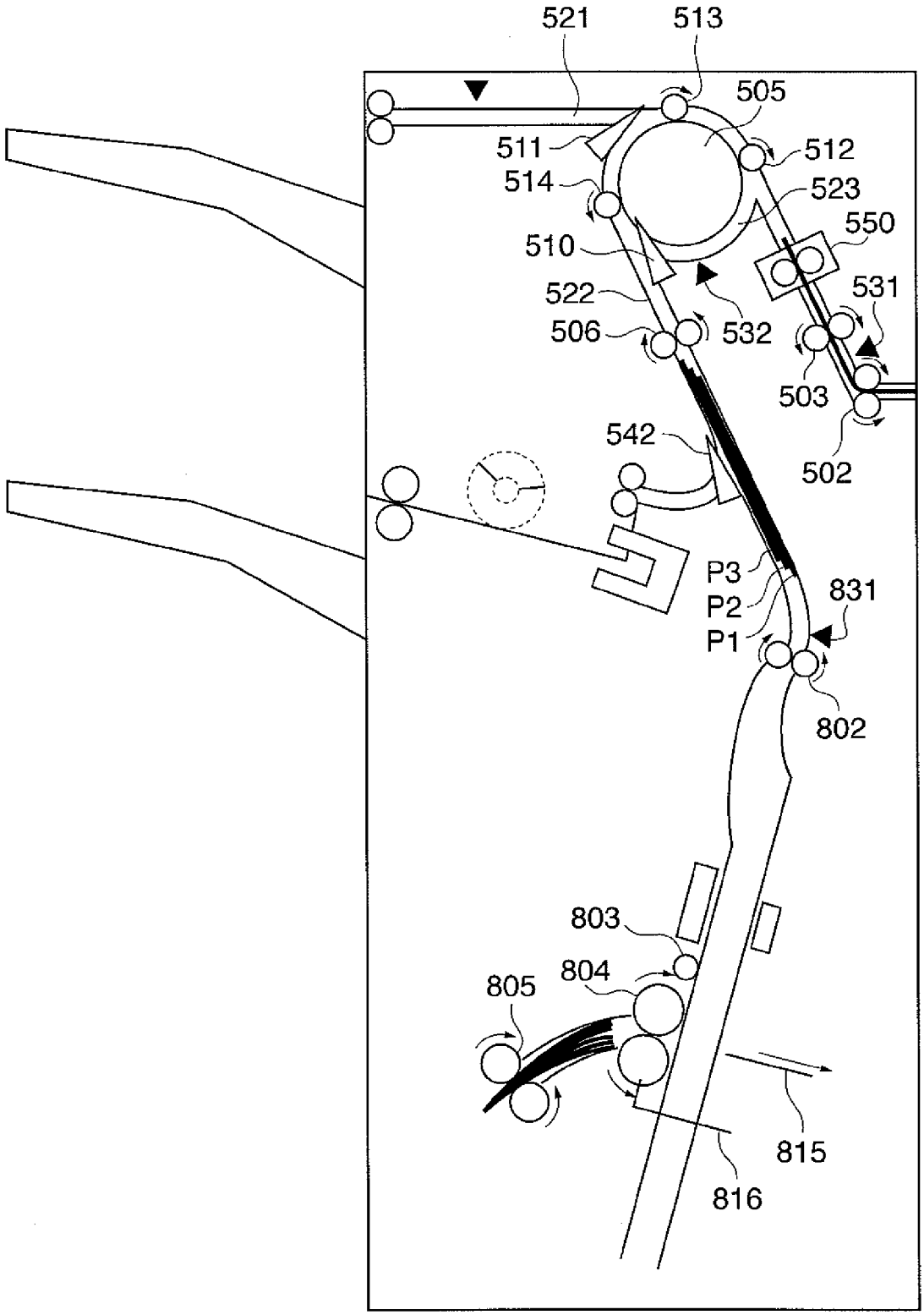
FIG. 33 is a view useful in explaining the flow of sheets of the second bundle, which shows a state following a state of FIG. 32.
Figure 34:
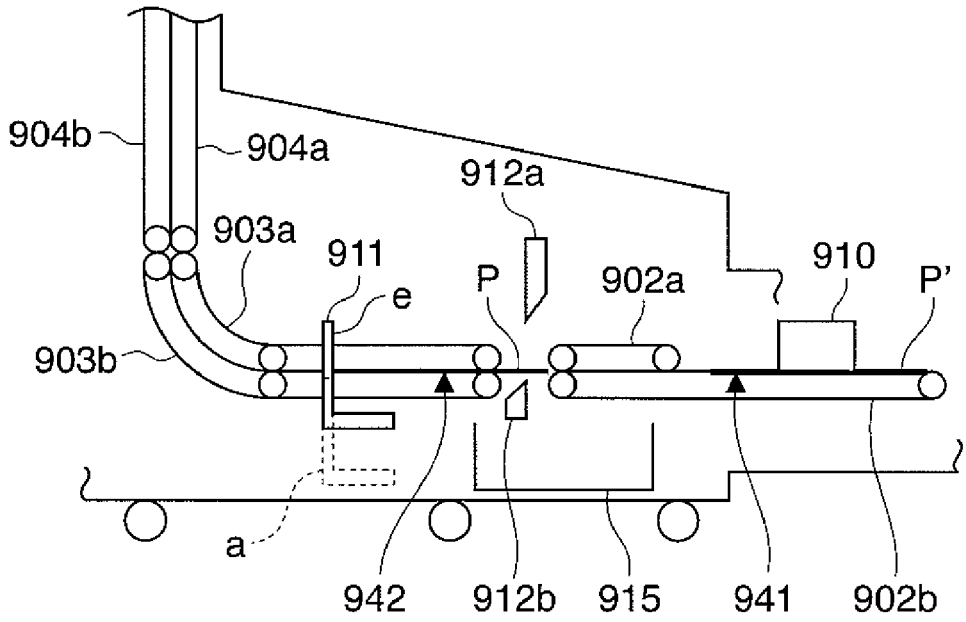
FIG. 34 is a view useful in explaining a flow of sheets in a cutting mode.
Figure 35:
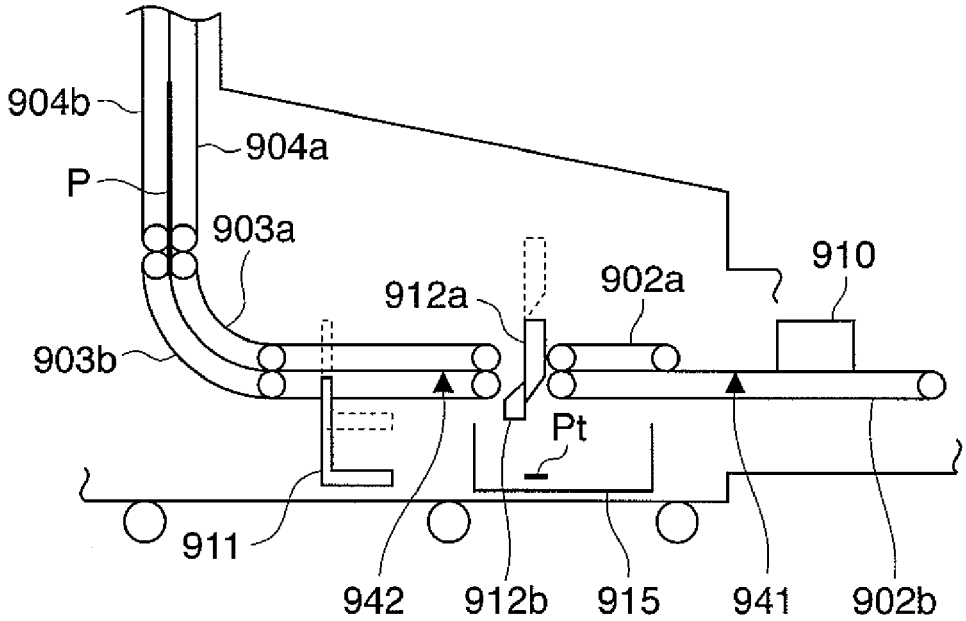
FIG. 35 is a view useful in explaining the flow of sheets in the cutting mode, which shows a state following a state of FIG. 34.

A description will be given of how sheets (second copy) are conveyed during a time period from the start of taking-in of the sheets P (first copy) to the discharge of the same as a sheet bundle. FIGS. 32 and 33 are views useful in explaining a flow of sheets in the bookbinding mode for the second sheet bundle.

When discharged from the image forming apparatus 10, similarly to the case of the second sheet bundle in the sorting mode, a sheet P1 as a first page of the second sheet bundle is wound around the buffer roller 505 by the switching operation of the switching flapper 510. The buffer roller 505 is stopped when the sheet P1 is conveyed by a predetermined distance from the buffer path sensor 532.

When the leading edge of a sheet P2 as a second page is advanced from the inlet sensor 531 by a predetermined distance, the buffer roller 505 starts to be rotated, whereby the sheet P2 is laid over the sheet P1 such that the sheet P2 is advanced from the sheet P1 by a predetermined distance. After the sheet P2 is laid over the sheet P1, the sheets P1 and P2 are conveyed into the buffer path 532 again (see FIG. 32), and a further following sheet P3 is laid over them.

The sheets P1, P2, and P3 wound around the buffer roller 505 are peeled off the buffer roller 505 by the switching operation of the switching flapper 510, and is conveyed as a three-sheet bundle P into the sorting path 522 (see FIG. 33). At this time point, the center-folding operation of the sheet bundle received in the bookbinding tray 830 has been completed. Further, the sheet positioning member 816 has been moved from a position for the folding process on the preceding sheet bundle to a position for stapling a next sheet bundle. Then, the three-sheet bundle is discharged into the bookbinding tray 830 by the conveying roller pair 802 and the intermediate roller 803.

A fourth and following sheets are each discharged into the bookbinding tray 830 via the sorting path 522 and the bookbinding path 525 in the same manner as the first sheet bundle. It should be noted that in the present embodiment, three sheets are laid over each other, this is not limitative, but two sheets or four or more sheets may be laid over each other.

FIGS. 34 to 37 are views useful in explaining a flow of sheets in the cutting mode. A sheet bundle P' saddle-stitched and folded at the center in the bookbinding mode starts to be discharged from the discharge roller 805 of the finisher 500, the conveyor belts 902*a* and 902*b* start to be driven for rotation.

After the leading end of the sheet bundle P' is detected by the receipt sensor 941 provided for the conveyor belt 902*b*, the sheet bundle P' is conveyed over a predetermined distance, and at the time point of the trailing end of the sheet bundle P' being dropped on the conveyor belt 902*b*, the driving of the conveyor belts 902*a* and 902*b* are stopped. At this time, the leading end of the sheet bundle P' does not reach the conveyor belt 902*a*, and hence the sheet bundle P' is free without being sandwiched between the conveyor belts 902*a* and 902*b*. Then, the aligning members 901*a* and 901*b* perform an aligning operation for aligning the center of the conveying path and the center of the sheet bundle. When the aligning operation is finished, the conveyor belts 902*a* and 902*b* are driven again, whereby the sheet bundle P' is conveyed downstream.

In performing edge cutting, the edge-cutting stopper 911 is lifted up from the standby position (indicated by a solid line a in FIG. 34) to a position (indicated by a broken line e in FIG. 34) where it is protruded into the conveying path, and is further moved in the conveying direction to a position corresponding to the cutting amount. After the path sensor 942 detects the leading end of the sheet bundle P conveyed downstream by the conveyor belts 902 and 903, the sheet bundle P is conveyed by a predetermined distance, and then the conveyor belts 902 and 903 are stopped. At this time, the leading end of the sheet bundle P is in contact with the edge-cutting stopper 911, and the sheet bundle P is in a state sandwiched by the conveyor belts 903*a* and 903*b*. Further, at this time, the trailing end of the sheet bundle P has come out of the conveyor belts 902 (see FIG. 34).

The, the upper edge-cutting blade 912*a* is lowered to cut off the trailing end of the sheet bundle P, and the cut-off chips Pt drop by its own weight to be received in the edge-cut chip box 915 provided under the cutting blades. When the cutting operation is completed, the edge-cutting stopper 911 is lowered to free the conveying path. Then, the conveyor belts 903 and 904 are driven for rotation, whereby the sheet bundle P is conveyed further downstream (see FIG. 35).

On the other hand, when edge cutting is not performed, after aligning the sheet bundle P by the aligning members 910, the conveyor belts 902, 903, 904, and 905 are driven for rotation with the edge-cutting stopper 911 held in the lowered standby position, whereby it is conveyed downstream without being stopped at the edge cutting section.

Figure 36:
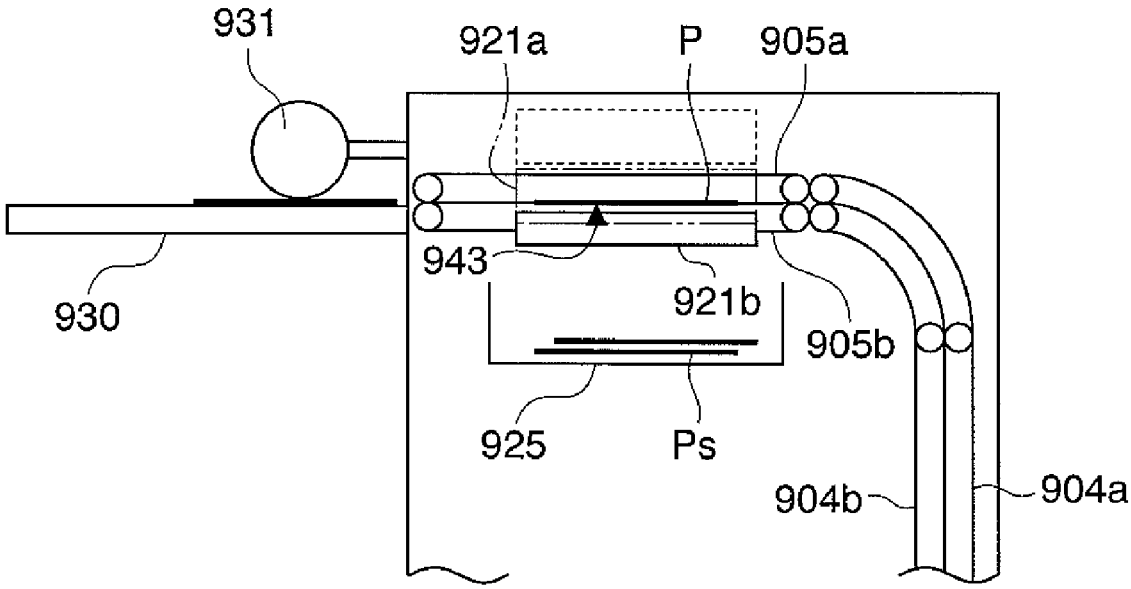
FIG. 36 is a view useful in explaining the flow of sheets in the cutting mode, which shows a state following a state of FIG. 35.
Figure 37:
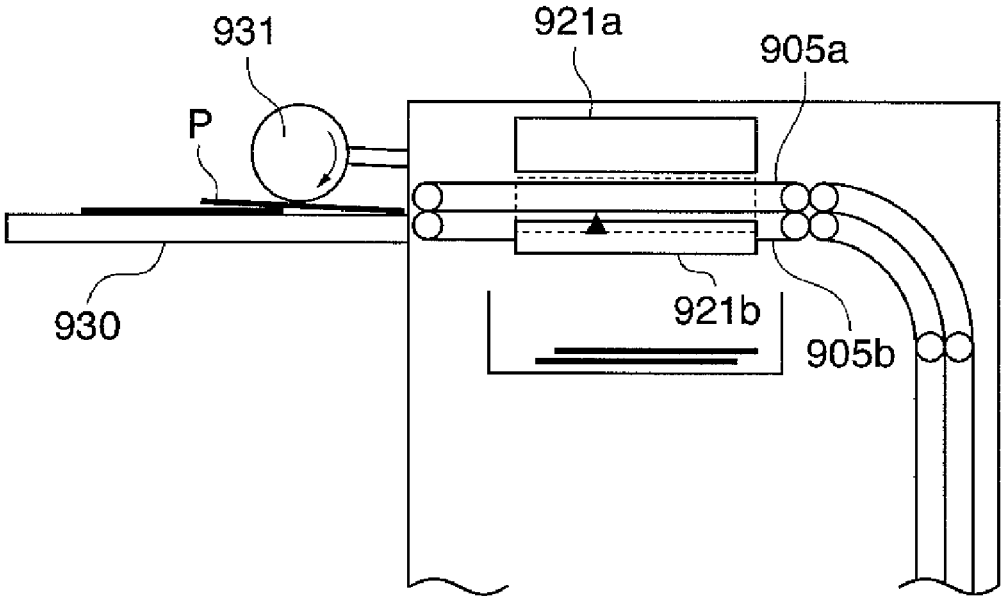
FIG. 37 is a view useful in explaining the flow of sheets in the cutting mode, which shows a state following a state of FIG. 36.

In performing top-and-bottom cutting on the sheet bundle P conveyed downstream by the conveyor belts 904, the sheet bundle P is conveyed by a predetermined distance after the path sensor 943 detects the leading end of the sheet, and then the driving of the conveyor belts 905 is stopped (see FIG. 36). When the sheet bundle P is being conveyed by the conveyor belts 904, the top-and-bottom cutting blades 921 and 922 are moved to respective positions corresponding to the cutting amounts. Then, the top-and-bottom cutting blades 921*a* and 922*a* are lowered to cut off the top and bottom ends of the sheet bundle P.

The cut-off chips Ps drop to be received in the top-and-bottom-cut chip box 925. Thereafter, when the cutting upper blades 921*a* and 922*a* are lifted the conveyor belts 905 are driven to discharge the sheet bundle P into the stack tray 930 (see FIG. 37). The large conveying roller 931 provided for the discharge tray is driven for rotation before it is reached by the leading end of the sheet bundle P, thereby causing the sheet bundle P to be moved toward the discharge tray 930.

Figure 38:
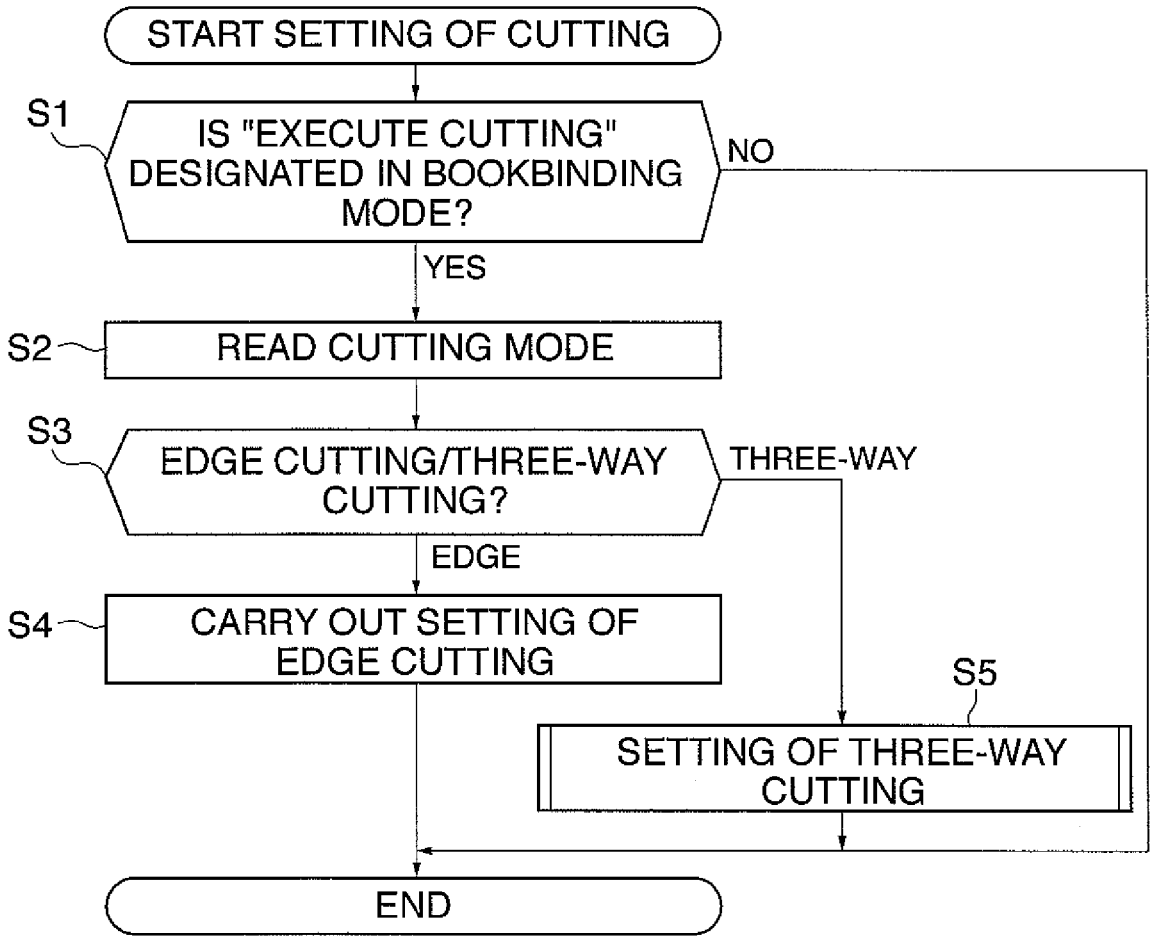
FIG. 38 is a flowchart showing a cutting setting process.

FIG. 38 is a flowchart of a cutting setting process. A program for the process is stored in the ROM 951 of the trimmer control section 901, and is executed by the CPU 950. First, information on settings made by soft keys on the display 420 via the finisher control section 501 are read in, and it is determined whether or not "execute cutting" is set for the bookbinding mode (step S1). If "execute cutting" is not set, the present process is immediately terminated.

On the other hand, if "execute cutting" is set, the settings of the cutting mode are read in (step S2), and it is determined which of edge cutting and three-way cutting is set for the cutting mode (step S3). If edge cutting is set, the setting of edge cutting is executed (step S4). More specifically, the cutting length x from the sheet end is set. On the other hand, if three-way cutting is set, the setting of three-way cutting is executed (step S5). The process for setting three-way cutting will be described hereinafter. After executing the steps S4 and S5, the present process is terminated.

Figure 39:
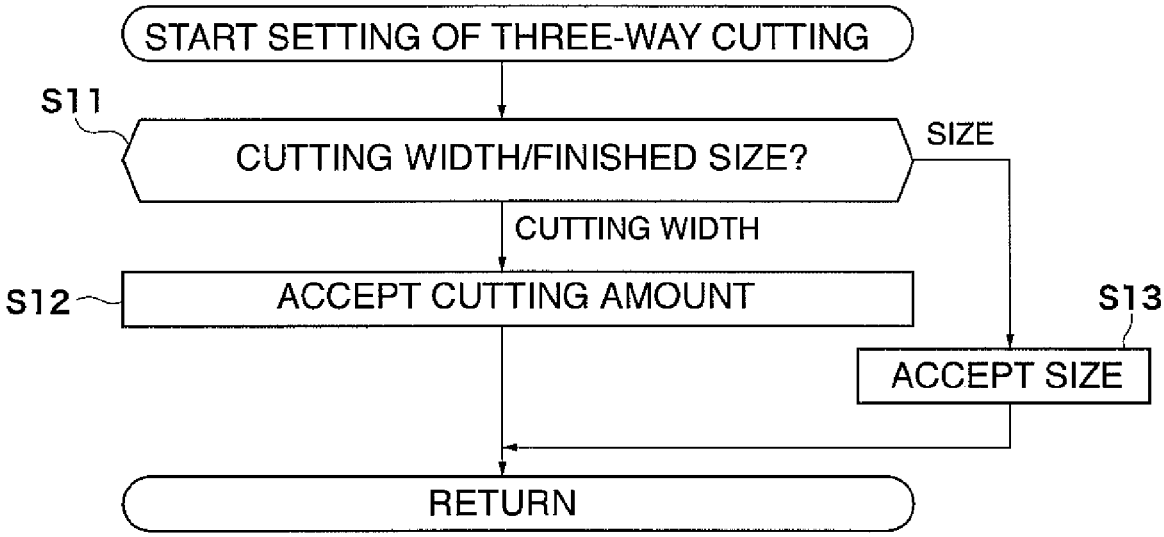
FIG. 39 is a flowchart showing a process for setting three-way cutting, which is executed in a step S5 in FIG. 38.

FIG. 39 is a flowchart showing the process for setting three-way cutting in the step S5 in FIG. 39. It is determined in a step S11 which of the cutting width designation and the finished size designation is selected on the cutting amount-setting screen (see FIG. 23). If the cutting width designation is selected, the cutting amount x for the edge side and the cutting amount y for the top and bottom sides are accepted (step S12). On the other hand, if it is determined in the step S11 that the finished size designation is selected, a standard size or a desired size is accepted (step S13), and the steps S12 and S13 are executed, followed by the present process returning to the parent process.

As described heretofore, in the image forming system according to the first embodiment, the user is capable of easily setting the cutting amount depending on the intended purpose of use. Therefore, the possibility of a user's error in the setting of the cutting amount can be reduced to improve the operability.

Next, a second embodiment of the present invention will be described. The arrangement of the image forming system according to the second embodiment is identical to that of the first embodiment. Therefore, a description will be given of only different operations while designating identical components by the same reference numerals, and omitting detailed description thereof.

FIGS. 40 to 45 are views useful explaining setting of the bookbinding mode and the cutting mode, according to the second embodiment. Similarly to the first embodiment, when the "bookbinding" key 251 is selected in the applied mode-selection screen (see FIG. 18), keys 441 to 445 enabling selection of a cassette containing recording sheets to be output are displayed (see FIG. 40). In the present embodiment, it is possible to select from A4-size (210 mm×297 mm) sheets, B5-size (257 mm×182 mm) sheets, A3-size (297 mm×420 mm) sheets, and SRA3-size (320 mm×450 mm) sheets. The SRA3 size is an elongated-size sheet which is slightly longer in the longitudinal and lateral directions than the A3 size.

Figure 40:
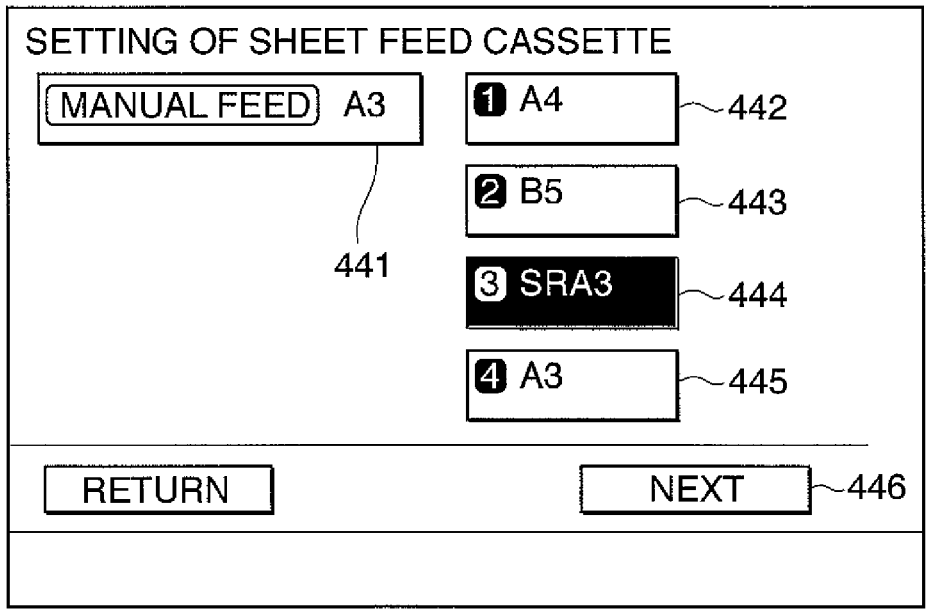
FIG. 40 is a view of a screen for setting the bookbinding mode and the cutting mode, displayed on an image forming system according to a second embodiment of the present invention.

On the setting screen shown in FIG. 40, if a cassette containing the sheets having a selected size is selected, and a "next" key 446 is depressed, it becomes possible, similarly to the first embodiment, to select whether to perform saddle stitching on the sheet bundle and whether to perform edge cutting or three-way cutting, independently of each other (see FIGS. 20 and 21). Here, irrespective of how saddle stitching is set, if the "don't execute cutting" key 354 is selected, and the "OK" key 355 is depressed, the setting is terminated, and the process returns to the initial screen (see FIG. 3). Then, the process waits for the start key 402 to be depressed to start image-forming and post-processing operations. On the other hand, after the "execute cutting" key 353 is selected, if the "edge cutting" key 361 or the "three-way cutting" key 362 is selected, and then the "OK" key 363 is depressed, a screen associated with the selected size set in the setting screen (see FIG. 40) is displayed.

Figure 41:
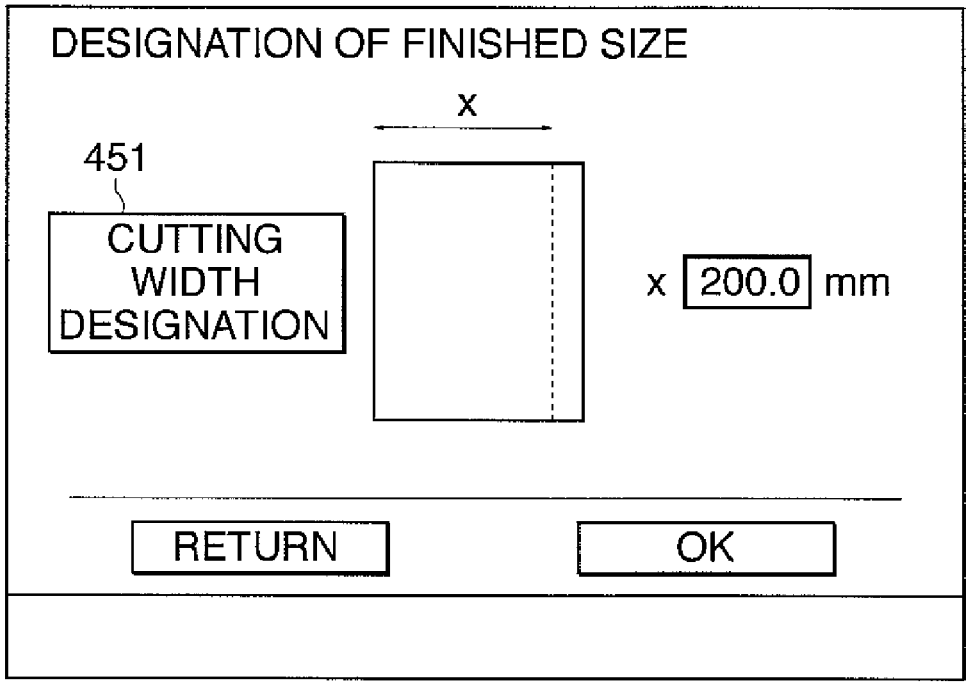
FIG. 41 is a view of a finished size designation screen displayed for setting the bookbinding mode and the cutting mode.

In the case where a "SRA3" key 444 for sheets having an elongated size is selected, and edge cutting is to be performed, a screen is displayed in which a finished size which sheets should have after being cutting is required to be entered by the ten-key pad of the operating/display unit 400 (see FIG. 41). On this screen, if the "cutting width designation" key 451 is depressed, the screen is switched to a cutting width designation screen for designating a cutting length from a sheet end (see FIG. 42). Within the cutting width designation screen, there is provided a "finished size designation" key 453, and if this key 453 is depressed, the screen is switched to a finished size designation screen (see FIG. 41). Therefore, the user can arbitrarily switch between whether to designate a finished size or to designate a cutting length.

Figure 42:
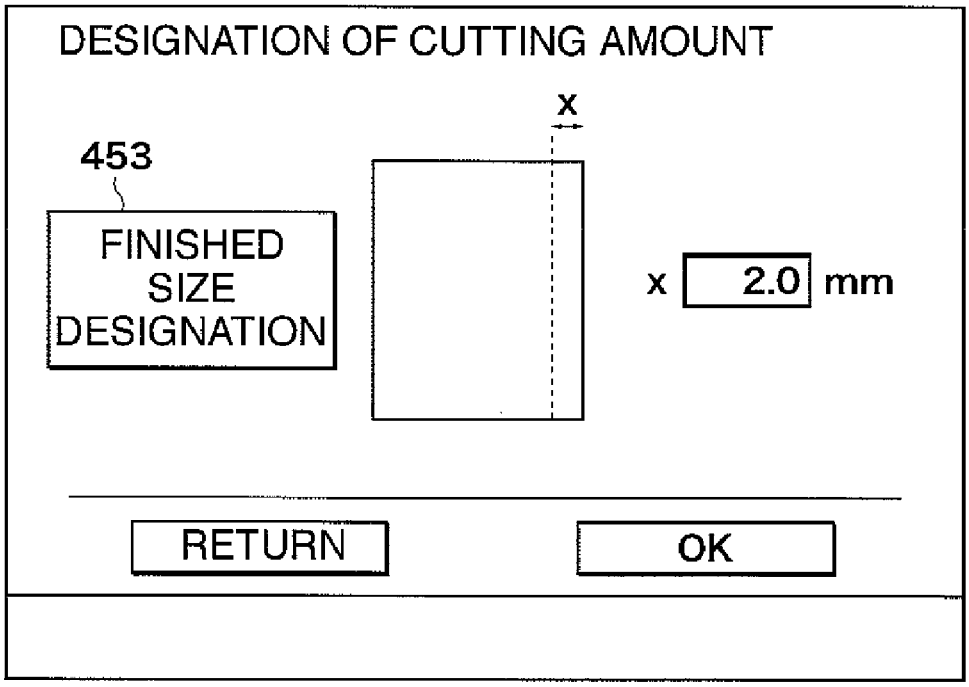
FIG. 42 is a view of a cutting width designation screen displayed for setting the bookbinding mode and the cutting mode.

On the other hand, if the "A3" key 445 for a standard size sheet is selected on the sheet cassette-setting screen (see FIG. 40), and if edge cutting is to be executed, the screen is switched to a cutting amount-setting screen for entering a cutting length from the ten-key pad of the operating/display unit 400 (see FIG. 42). In this case as well, it is possible to switch the screen to the finished size designation screen (see FIG. 41) by depressing the "finished size designation" key 435.

Figure 43:
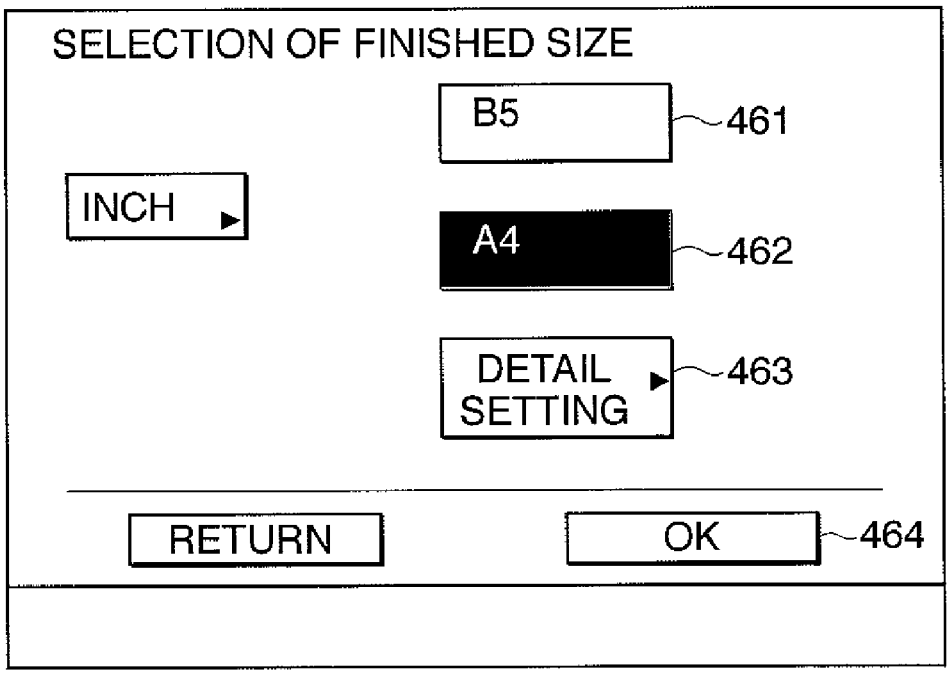
FIG. 43 a view of a finished size selection screen displayed for setting the bookbinding mode and the cutting mode.
Figure 44:
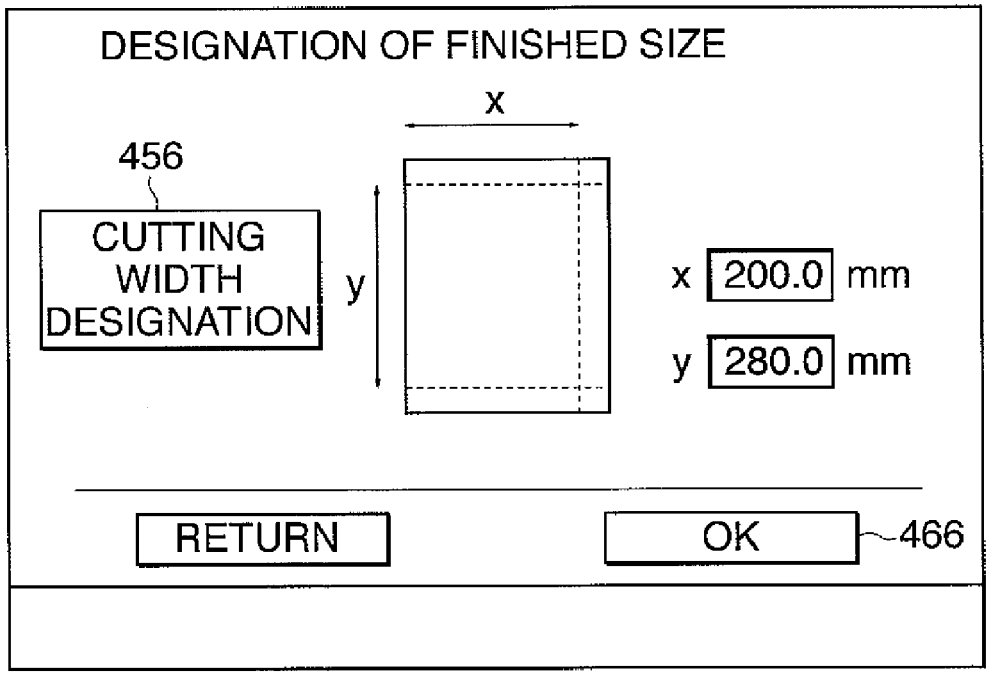
FIG. 44 a view of a finished size designation screen displayed for setting the bookbinding mode and the cutting mode.

Further, if the "SRA3" key 444 is selected, and three-way cutting is to be executed, if the "OK" key 363 is depressed on the cutting setting screen (see FIG. 21), the screen is switched to a finished size selection screen (see FIG. 43). On the finished size selection screen, it is possible to select any of keys 461 and 462 for standard sizes (A4, B5, etc.), and a "detail setting" key 463 enabling selection of arbitrary sizes other than the standard sizes. As to the standard sizes, it is possible to switch between A/B-type sizes and inch-type sizes. When a standard size is selected and the "OK" key 464 is depressed, the setting is terminated and the process returns to the initial screen (see FIG. 3).

On the other hand, if the "detail setting" key 463 is selected, the screen is switched to a finished size designation screen (see FIG. 44) for entering a finished length x in a direction associated with edge cutting and a finished length y in a direction associated with top-and-bottom cutting from the ten-key pad of the operating/display unit 400. Then, after the entry, if the "OK" key 466 is depressed, the setting is terminated, and the process returns to the initial screen (see FIG. 3).

Figure 45:
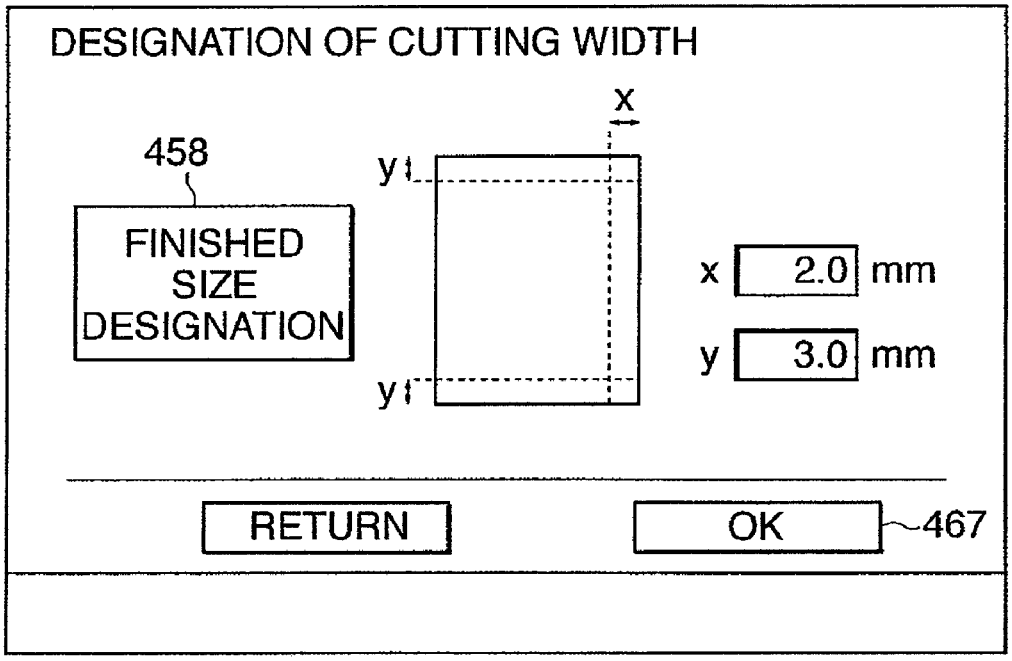
FIG. 45 is a view of a cutting width designation screen displayed for setting the bookbinding mode and the cutting mode.
Figure 46:
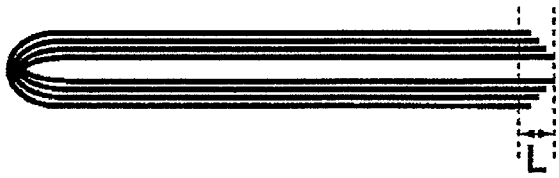
FIG. 46 is a view of a bundle of sheets subjected to a conventional saddle stitching and center-folding process.

If the "cutting width designation" key 456 is selected on the finished size designation screen (see FIG. 44), the screen is switched to a cutting width designation screen (see FIG. 45). On this screen, after entering a cutting amount (cutting length) x for edge cutting and a cutting amount (cutting length) y for top-and-bottom cutting, if the "OK" key 467 is depressed, the setting is terminated, and the process returns to the initial screen (see FIG. 3). If the "finished size designation" key 458 is selected on the cutting width designation screen (see FIG. 45), the screen is switched to the finished size designation screen (see FIG. 43).

If the standard size A3 is selected on the cutting setting screen (see FIG. 21), and the three-way cutting is to be executed, the screen is switched to the cutting width designation screen (see FIG. 45) for designating a cutting length. Here, by selecting the "finished size designation" key 458, it is possible to switch the screen to the finished size designation screen (see FIG. 43).

As described above, in the image forming system according to the second embodiment, when the size of sheets used in the cutting mode is an elongated size, the screen is preferentially switched to a screen for setting a finished size, whereas if the same is a standard size, the screen is preferentially switched to a screen for setting a cutting length. This makes it possible to improve the operability.

It should be noted that the present invention is not limited to the above-described arrangements of the respective embodiments, but any suitable arrangement may be employed insofar as it can attain the functions of each of the embodiments.

For example, the present invention may be applied to a system comprising a plurality of apparatuses or a unit formed by a single apparatus. Further, it is to be understood that the image forming apparatus may be not only a printer originally intended as such, there may be employed a facsimile machine having a printing function, or a multifunction peripheral (MFP) having a printing function, a copying function, a scanner function, etc.

Although in the above described embodiments, the printing process carried out by the multi-function apparatus is the electrophotographic process, the present invention is not limited to this, but the present invention may be applied to various printing processes such as inkjet printing, thermal transfer printing, thermal printing, electrostatic printing, and discharge breakdown printing.

Further, the image forming apparatus may be connected to various optional devices (also called accessories) that expands the functions of the image forming apparatus, as desired, according to the user's demand. For example, as the optional device, there may be mentioned a paper deck capable of feeding or conveying a large number of sheets. Further, there may be mentioned a puncher for punching holes for filing in sheets, and an automatic double-sided sheet feeder for forming images on both sides of each sheet. Further, there may be mentioned an interleaving device for inserting another sheet between sheets. Further, there may be mentioned an automatic document feeder for automatically feeding originals to a scanner, and a fixing and post-processing device for processing output images into higher-quality images.

It is to be understood that the object of the present invention may also be accomplished by supplying a system or an apparatus with a storage medium in which a program code of software, which realizes the functions of either of the above described embodiments is stored, and causing a computer (or CPU or MPU) of the system or apparatus to read out and execute the program code stored in the storage medium.

In this case, the program code itself read from the storage medium realizes the functions of either of the above described embodiments, and therefore the program code and the storage medium in which the program code is stored constitute the present invention.

Examples of the storage medium for supplying the program code include a Floppy® disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of either of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed the embodiments. The scope of the following claims is to be accorded the broadest interpretation so as to encompass all such modifications and equivalent structures and functions.

This application claims the benefit of Japanese Patent Application No. 2006-125691, filed Apr. 28, 2006 which is hereby incorporated by reference herein in its entirety.

What is claimed is:

1. A sheet processing apparatus that processes sheets, comprising:

a center-folding unit adapted to fold the sheets at a center thereof;

a cutting unit adapted to cut off at least one end of the folded sheets;

a selecting unit adapted to select between a one-end cutting mode in which one end of the folded sheets opposite to a folded end thereof is cut off, and a multiple-end cutting mode in which a plurality of ends of the folded sheets except the folded end are cut off; and a setting unit adapted to set a cutting amount in a first cutting amount-setting mode in which a cutting amount is set using a length from the one end of the folded sheets, in a case where said selecting unit selects the one-end cutting mode, wherein said setting unit is further adapted to set the cutting amount in a second cutting amount-setting mode in which the cutting amount is set using a sheet size which the sheets should have after being cut, in a case where said selecting unit selects the multiple-end cutting mode.

2. A sheet processing apparatus as claimed in claim 1, wherein said setting unit is adapted to set the cutting amount in a selected one of the first cutting amount-setting mode or the second cutting amount-setting mode, depending on the size of the sheets to be processed.

3. A sheet processing apparatus as claimed in claim 2, wherein when the size of the sheets to be processed is a standard size, said setting unit is adapted to set the cutting amount in the first cutting amount-setting mode, whereas when the size of the sheets to be processed is an elongated size, said setting unit is adapted to set the cutting amount in the second cutting amount-setting mode.

4. A sheet processing apparatus as claimed in claim 1, further comprising a saddle-stitching unit adapted to perform saddle stitching on a plurality of sheets laid over each other, and wherein said setting unit is adapted to set whether to carry out both the saddle stitching and the folding of the sheets at the center thereof or to carry out only the folding of the sheets at the center thereof without performing the saddle stitching.

5. An image forming system that includes an image forming apparatus and a sheet processing apparatus, in which sheets on which images are formed by the image forming apparatus are processed by the sheet processing apparatus, comprising:

a receiver unit adapted to receive sheets discharged from the image forming apparatus;

a center-folding unit adapted to fold the sheets at a center thereof;

a cutting unit adapted to cut off at least one end of the folded sheets;

a selecting unit adapted to select between a one-end cutting mode in which one end of the folded sheets opposite to a folded end thereof is cut off, and a multiple-end cutting mode in which a plurality of ends of the folded sheets except the folded end are cut off; and a setting unit adapted to set a cutting amount in a first cutting amount-setting mode in which a cutting amount is set using a length from the one end of the folded sheets, in a case where said selecting unit selects the one-end cutting mode, wherein said setting unit is further adapted to set the cutting amount in a second cutting amount-setting mode in which the cutting amount is set using a sheet size which the sheets should have after being cut, in a case where said selecting unit selects the multiple-end cutting mode.

* * * * *